US010998619B2

(12) United States Patent
Kim et al.

(10) Patent No.: US 10,998,619 B2
(45) Date of Patent: May 4, 2021

(54) RING TYPE ANTENNA MODULE AND JIG FOR MANUFACTURING SAME

(71) Applicant: AMOTECH CO., LTD., Incheon (KR)

(72) Inventors: Beon-Jin Kim, Bucheon-si (KR); Chi-Ho Lee, Incheon (KR); Dong-Hyun Im, Bucheon-si (KR)

(73) Assignee: AMOTECH CO., LTD., Incheon (KR)

( * ) Notice: Subject to any disclaimer, the term of this patent is extended or adjusted under 35 U.S.C. 154(b) by 64 days.

(21) Appl. No.: 16/309,150

(22) PCT Filed: Jun. 9, 2017

(86) PCT No.: PCT/KR2017/006031
§ 371 (c)(1),
(2) Date: Dec. 12, 2018

(87) PCT Pub. No.: WO2017/222217
PCT Pub. Date: Dec. 28, 2017

(65) Prior Publication Data

US 2019/0181544 A1 Jun. 13, 2019

(30) Foreign Application Priority Data

Jun. 22, 2016 (KR) ..... 10-2016-0078167
Nov. 3, 2016 (KR) ..... 10-2016-0145884

(51) Int. Cl.
*H01Q 1/27* (2006.01)
*H01Q 7/00* (2006.01)
(Continued)

(52) U.S. Cl.
CPC ..... *H01Q 1/38* (2013.01); *H01Q 1/273* (2013.01); *H01Q 7/00* (2013.01); *H01Q 7/06* (2013.01); *A44C 9/0053* (2013.01)

(58) Field of Classification Search
CPC ..... H01Q 1/273; H01Q 1/27; H01Q 1/38; H01Q 1/2216; H01Q 1/243; H01Q 7/00;
(Continued)

(56) References Cited

U.S. PATENT DOCUMENTS 8,602,310 B2 * 12/2013 Kato ..... H01Q 7/00 235/487
10,271,524 B2 * 4/2019 Chen ..... A01K 27/001
(Continued)

FOREIGN PATENT DOCUMENTS

CN 101005800 A 7/2007
CN 103488076 A 1/2014
(Continued)

OTHER PUBLICATIONS

Office Action issued in Chinese Application No. 201780039005.7, dated Mar. 11, 2020.

*Primary Examiner* — Tho G Phan
(74) *Attorney, Agent, or Firm* — CL Intellectual LLC

(57) ABSTRACT

A ring type antenna module and a jig for manufacture for manufacturing the same, which can communicate regardless of the orientation when mounted on a ring type wearable device and can easily process the size are provided. The ring type antenna module includes a base substrate having flexibility on which a radiation pattern is formed, a terminal part formed on one end of the base substrate and connected to one end of the radiation pattern, and the other terminal part formed on the other end of the base substrate and connected to the other end of the radiation pattern; and the size of the ring type antenna module is adjusted by varying the coupled location between the terminal part and the other terminal part.

13 Claims, 25 Drawing Sheets

(51) Int. Cl.

| | |
|---|---|
| ***H01Q 1/38*** | (2006.01) |
| ***H01Q 7/06*** | (2006.01) |
| *A44C 9/00* | (2006.01) |

(58) Field of Classification Search
CPC ..... H01Q 7/02; H01Q 7/06; H01Q 9/0464; A44C 9/0053; A61B 5/024; A61B 5/0245
See application file for complete search history.

(56) References Cited

U.S. PATENT DOCUMENTS

| | | | | |
|---|---|---|---|---|
| 10,601,136 | B2 * | 3/2020 | Lim ..... | H01Q 1/243 |
| 2014/0378853 | A1 | 12/2014 | McKinney et al. | |
| 2018/0343989 | A1 * | 12/2018 | McLear ..... | A44C 27/00 |

FOREIGN PATENT DOCUMENTS

| | | | |
|---|---|---|---|
| CN | 104754927 | A | 7/2015 |
| CN | 105340128 | A | 2/2016 |
| JP | 9-36640 | A | 2/1997 |
| JP | 2012198859 | A | 10/2012 |
| KR | 2004-0062644 | A | 7/2004 |
| KR | 2007-0043896 | A | 4/2007 |
| KR | 2007-0109766 | A | 11/2007 |
| KR | 2014-0109649 | A | 9/2014 |
| WO | 2016/010299 | A1 | 1/2016 |

* cited by examiner

[FIG. 1]
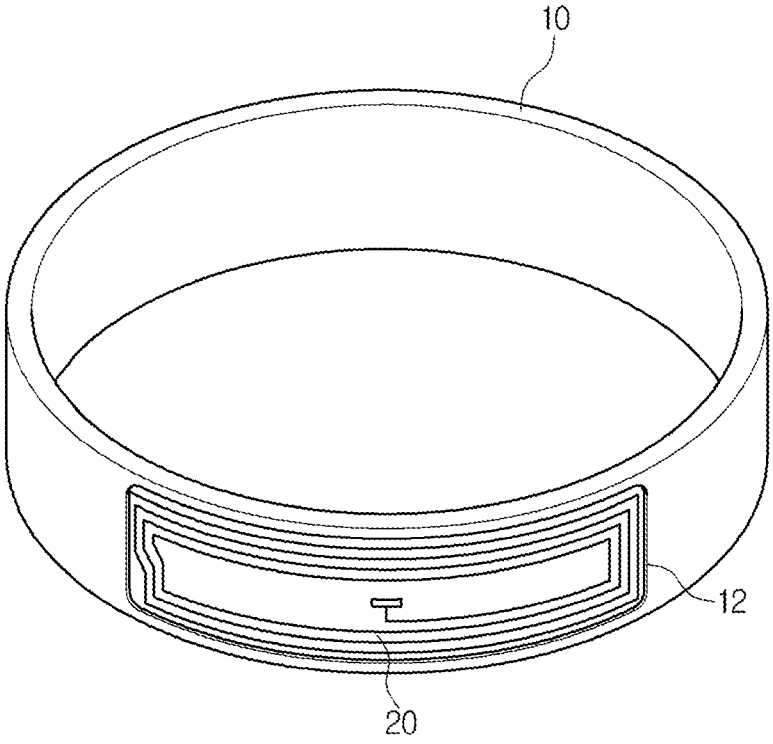

[FIG. 2]
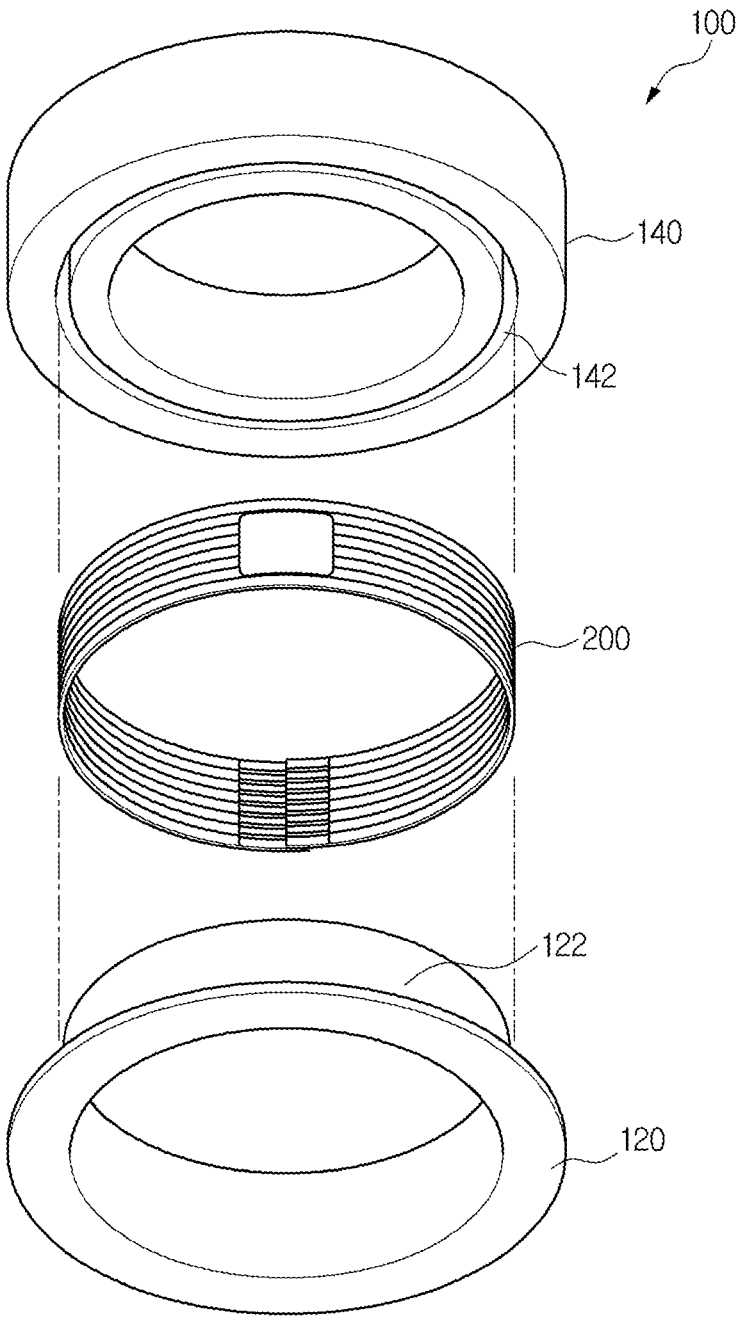

[FIG. 3]
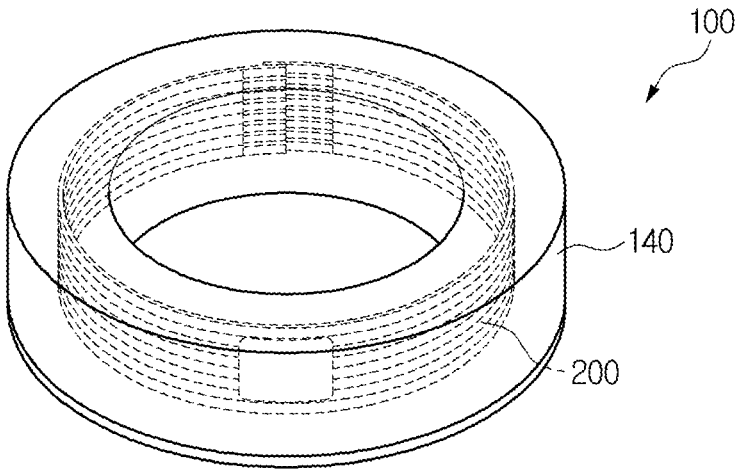
[FIG. 4]
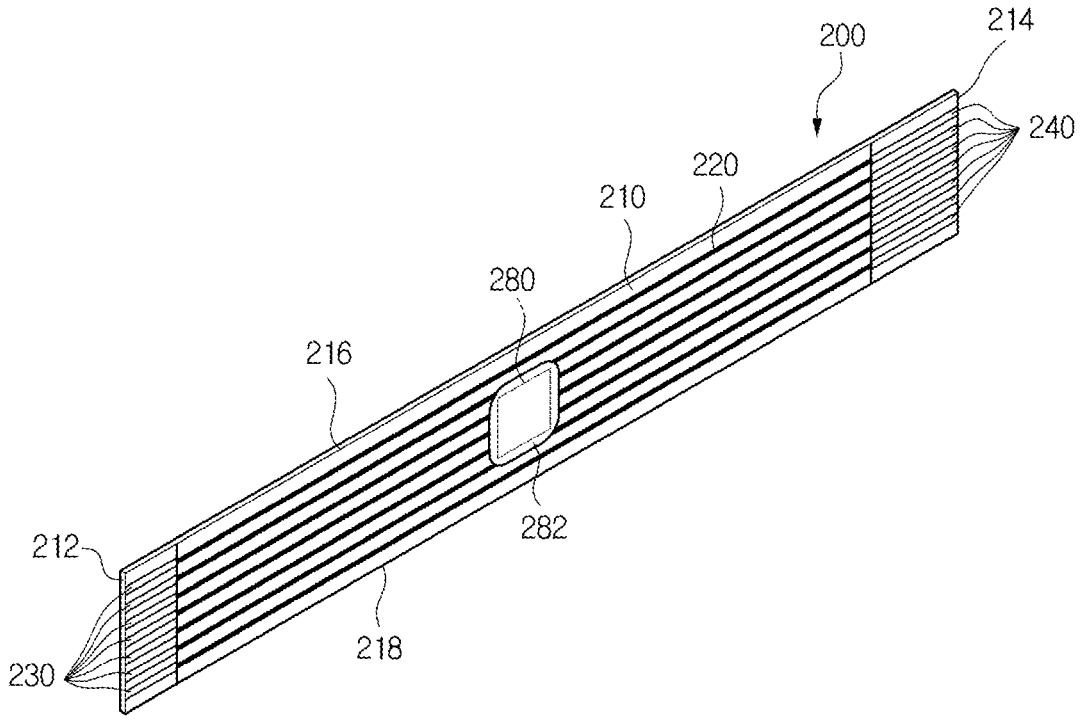

[FIG. 5]
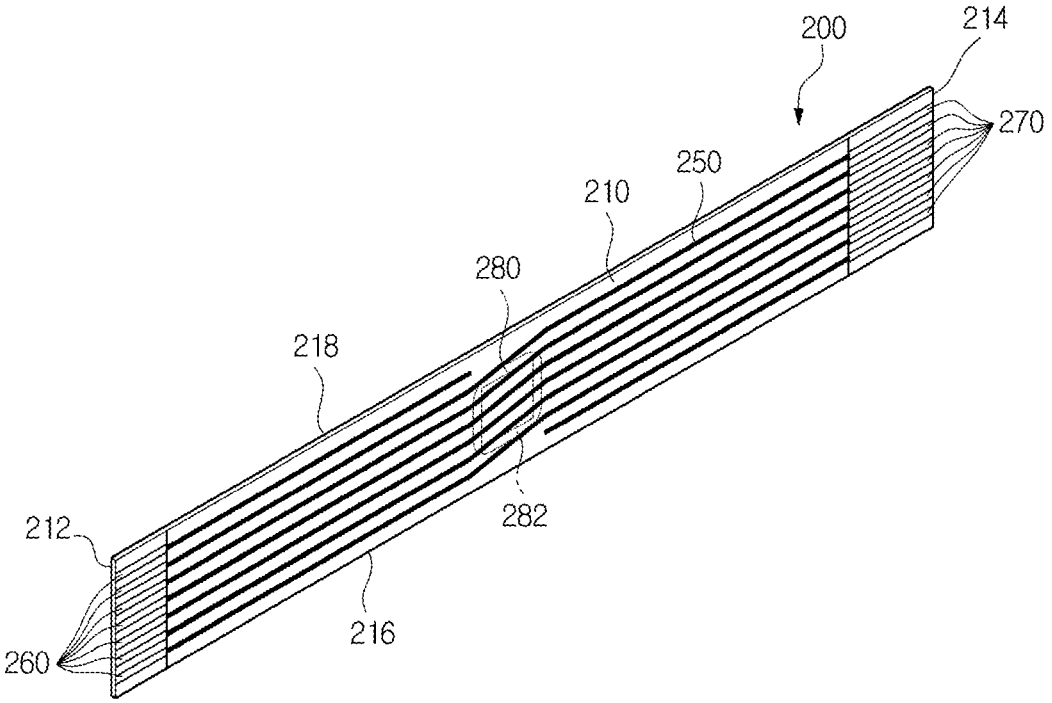
[FIG. 6]
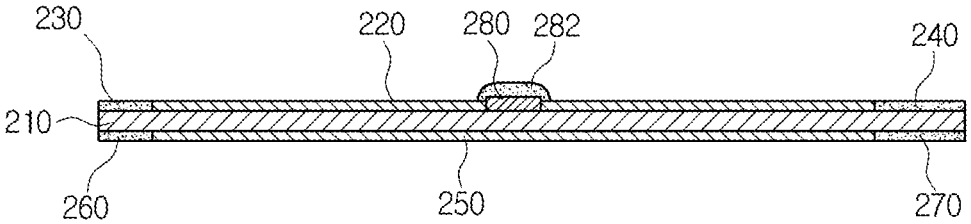

[FIG. 7]
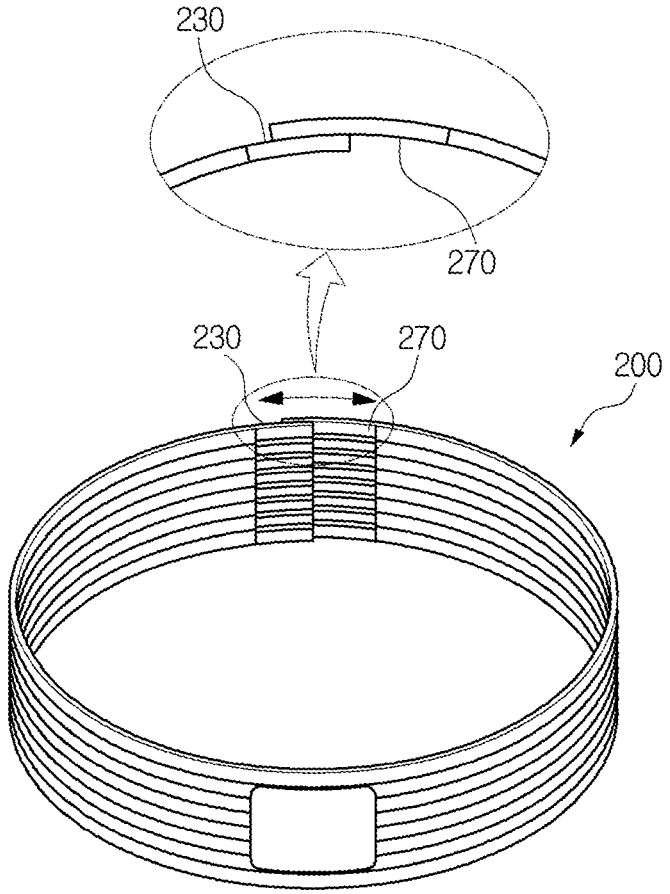

[FIG. 8]
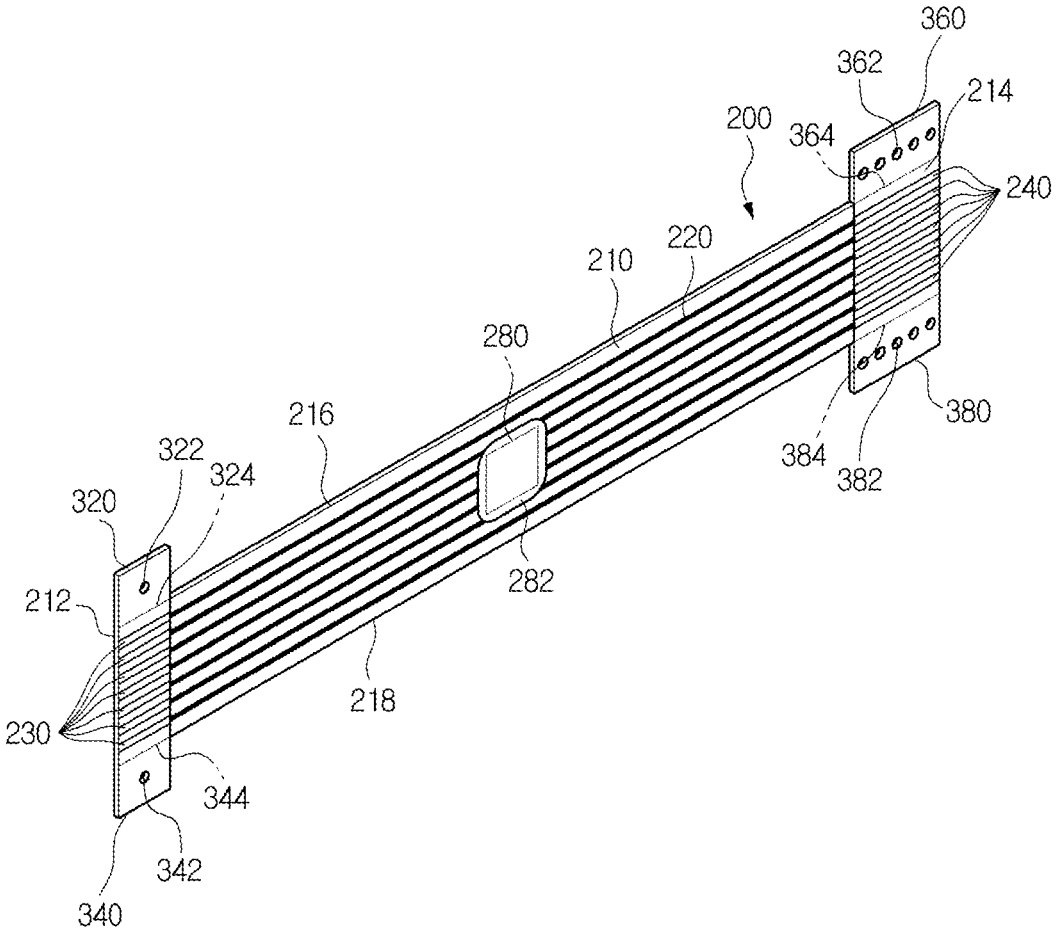

[FIG. 9]
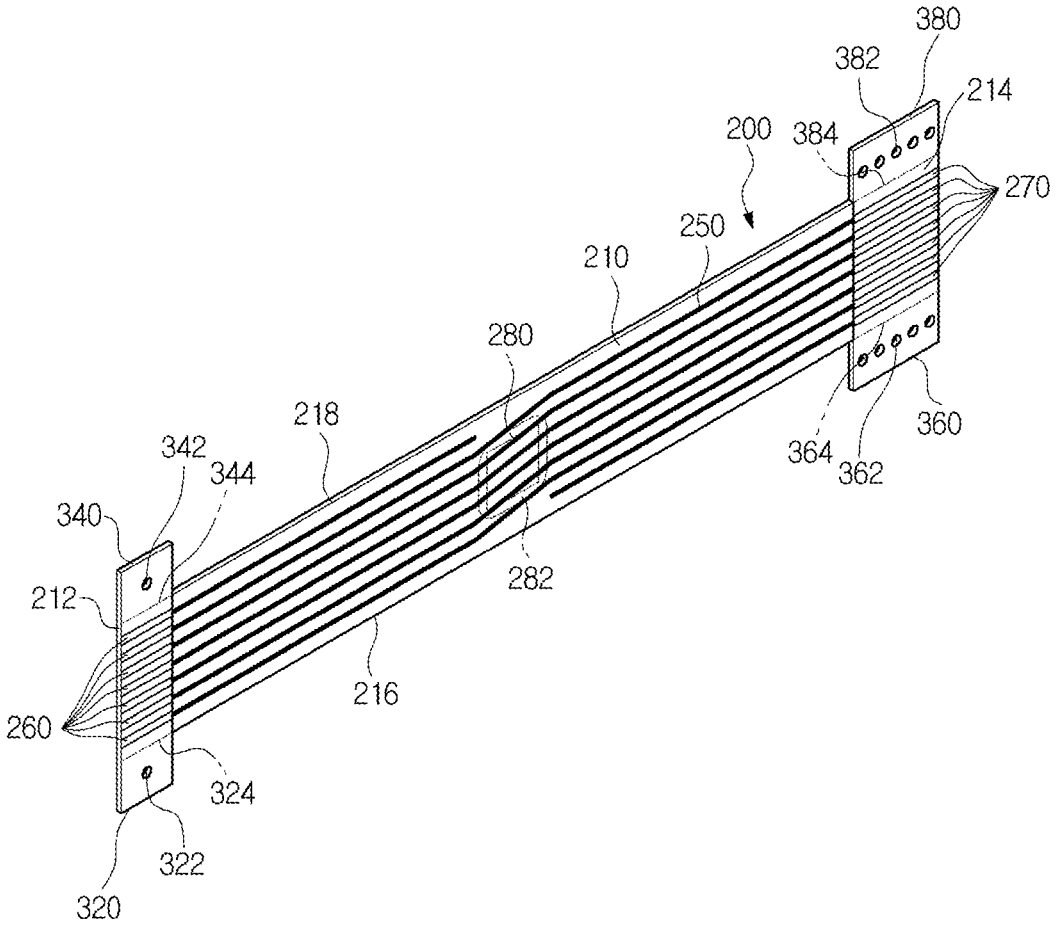

[FIG. 10]
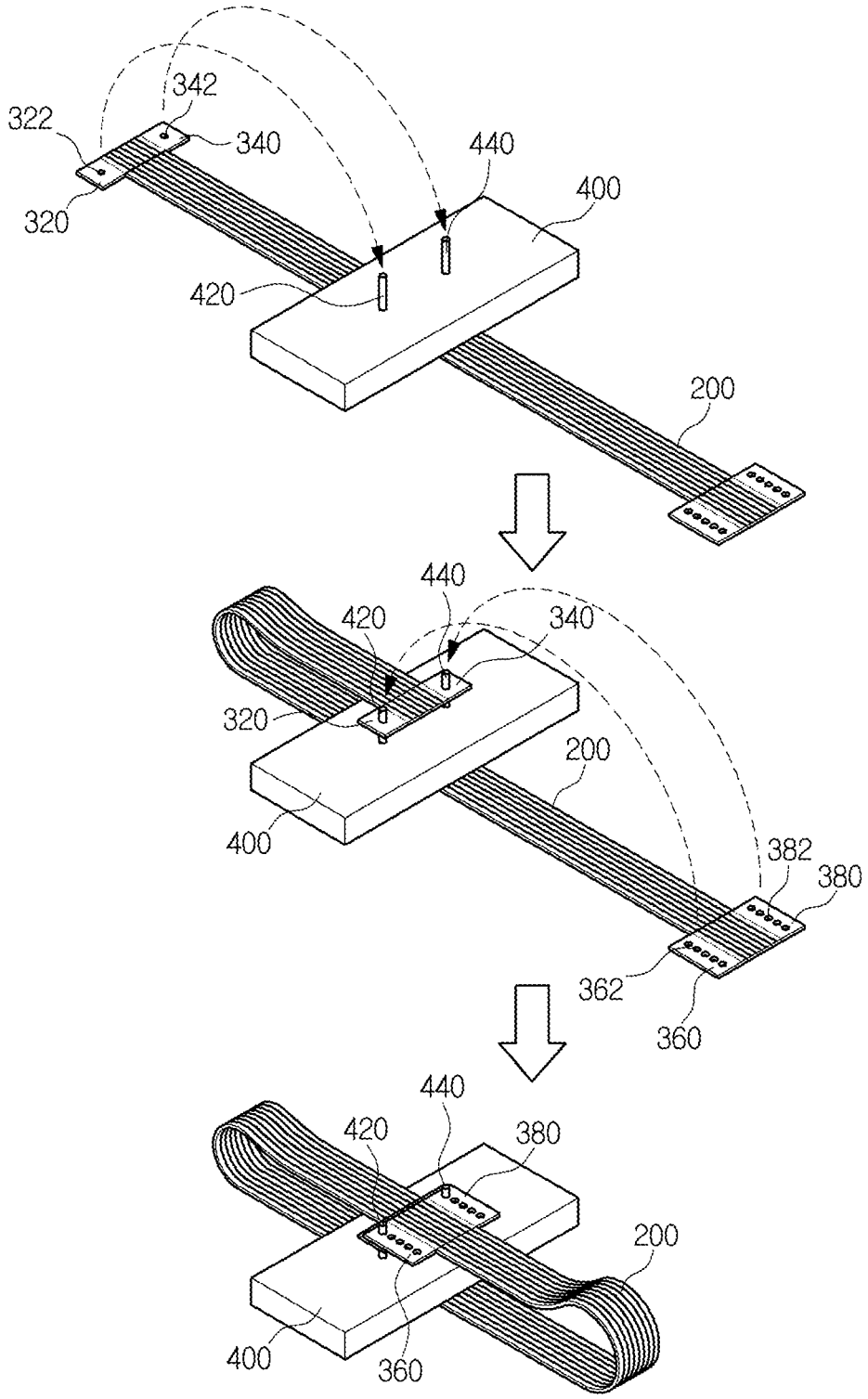

[FIG. 11]
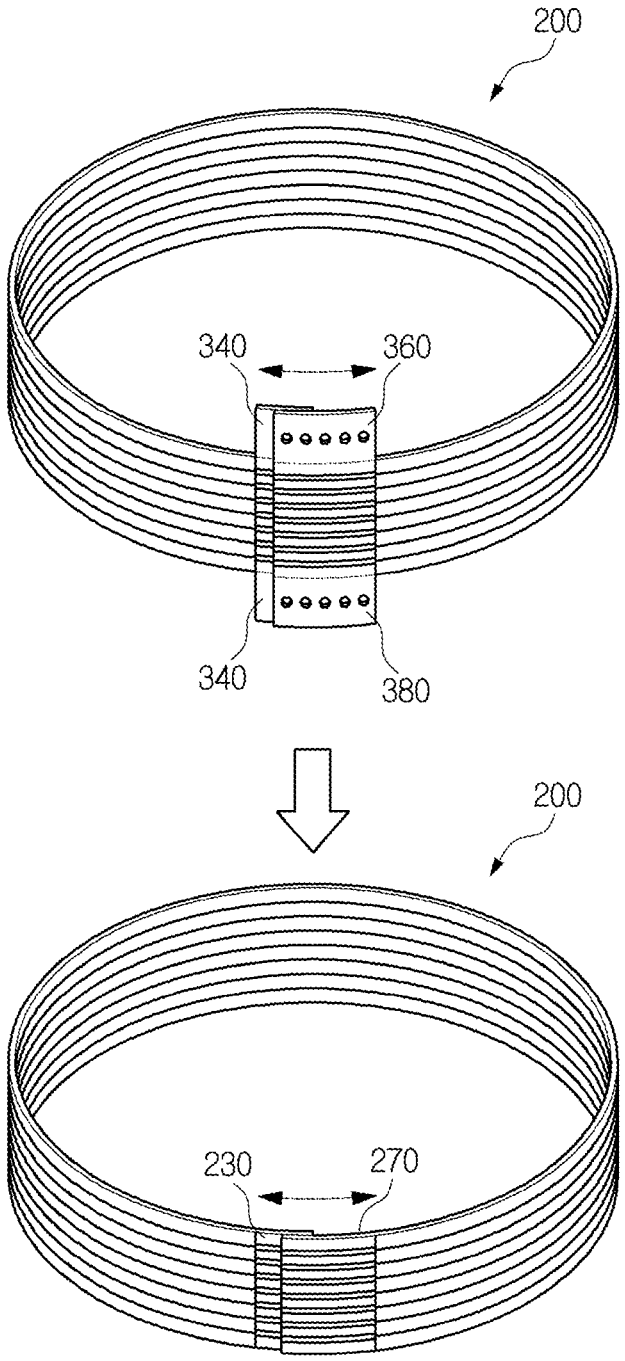

[FIG. 12]
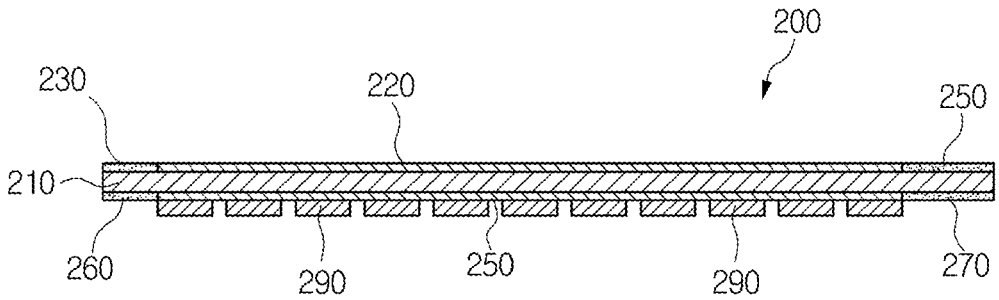
[FIG. 13]
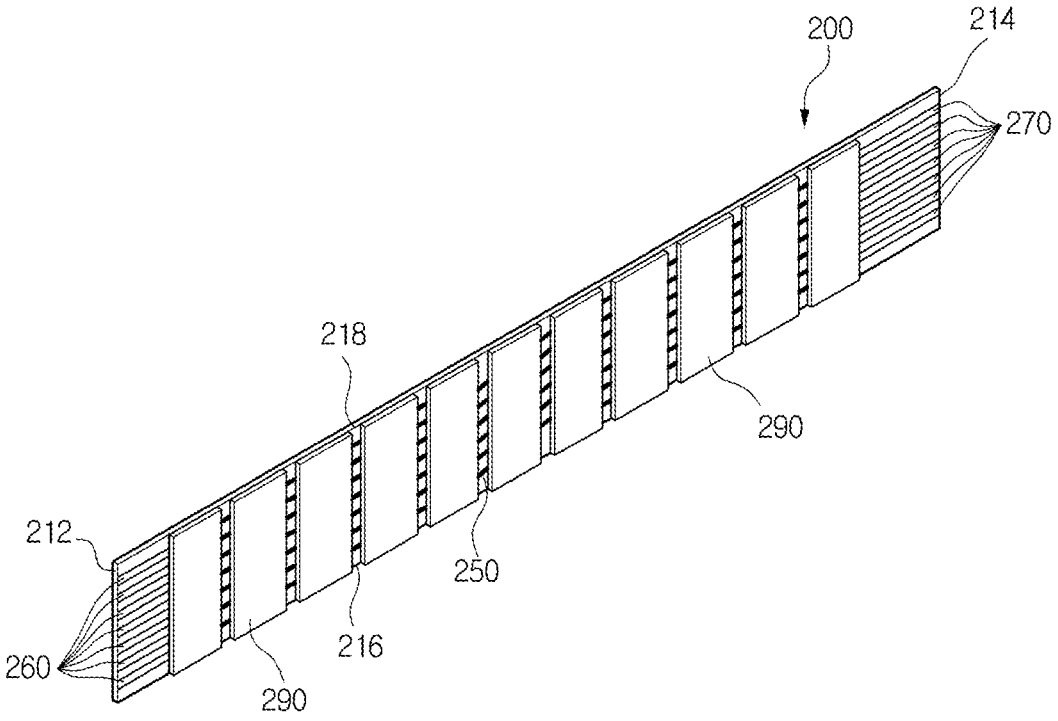

[FIG. 14]
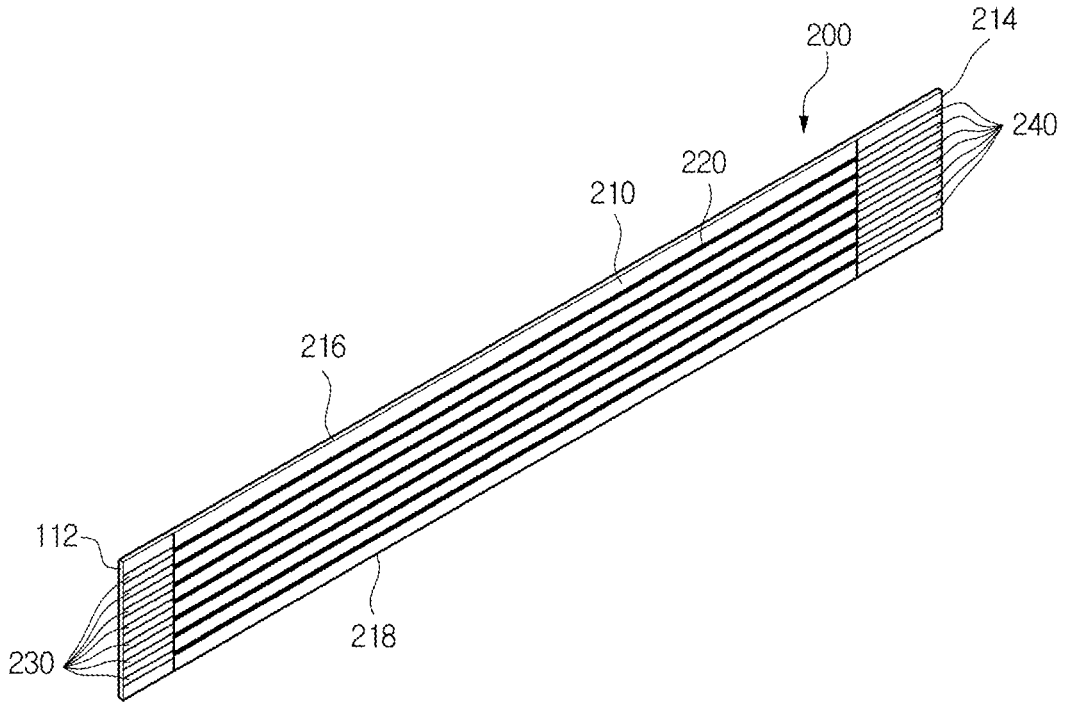

[FIG. 15]
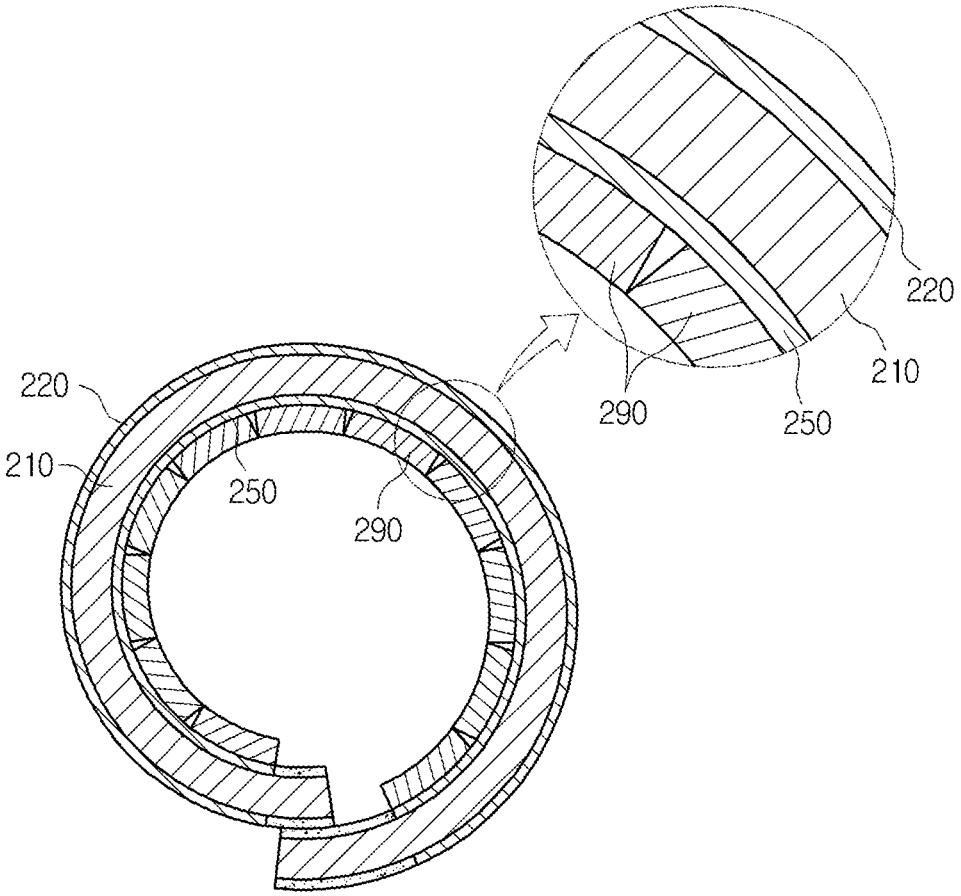
[FIG. 16]
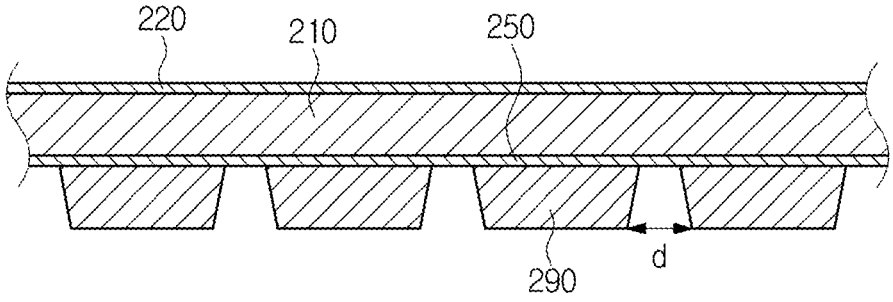

[FIG. 17]
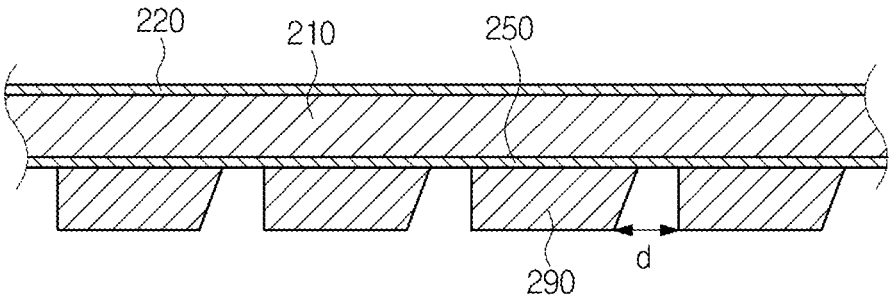
[FIG. 18]
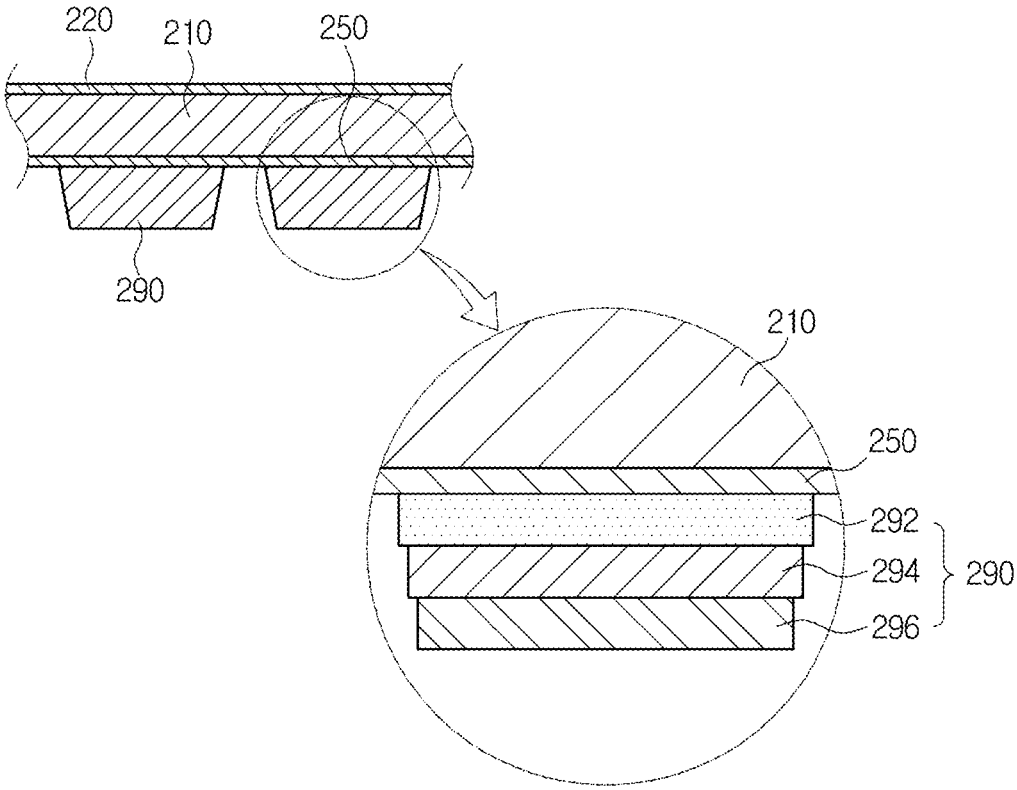

[FIG. 19]
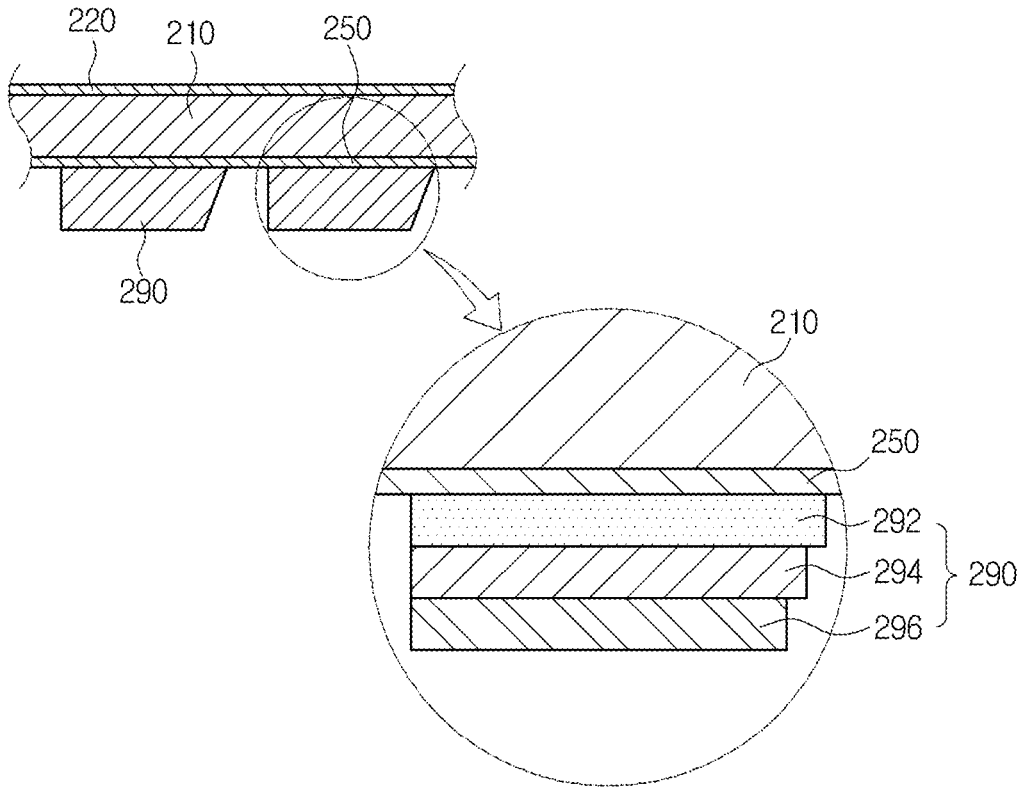

[FIG. 20]
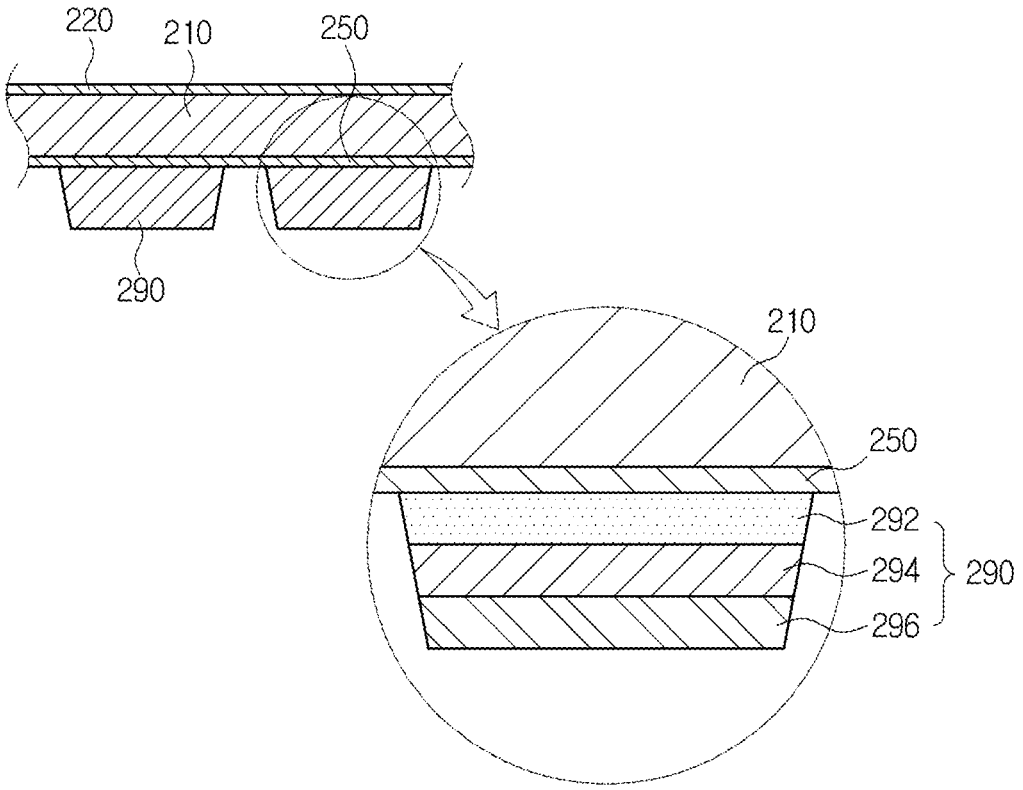

[FIG. 21]
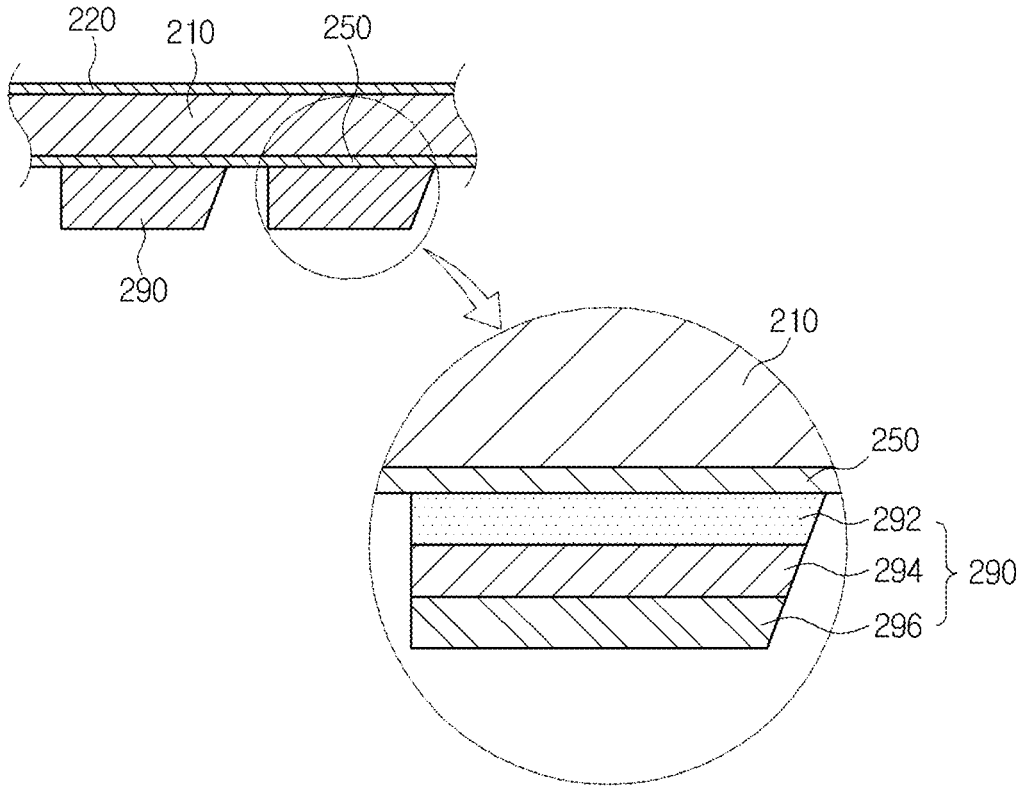

[FIG. 22]
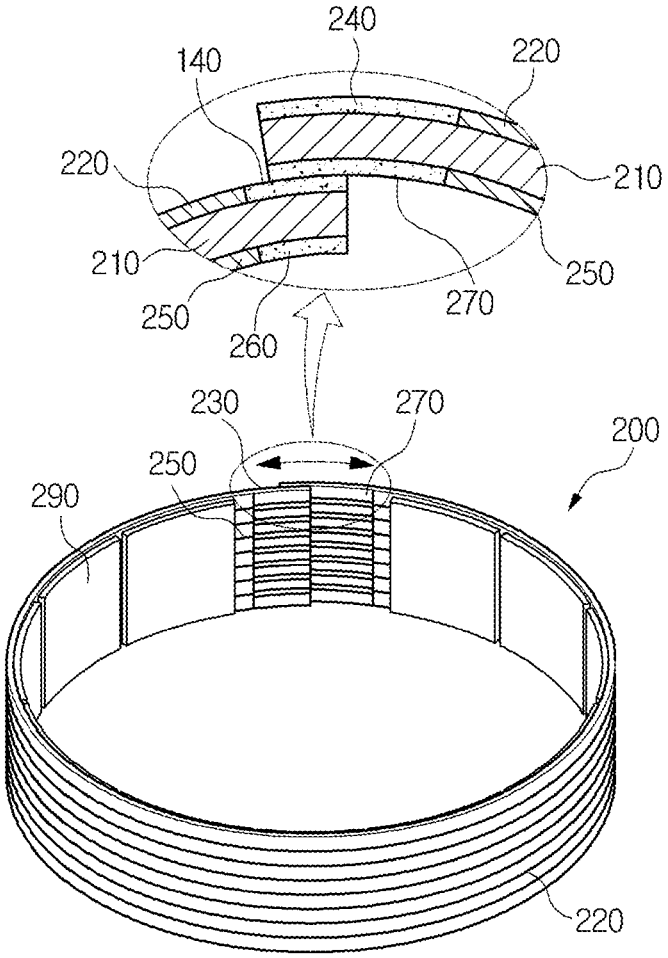

[FIG. 23]
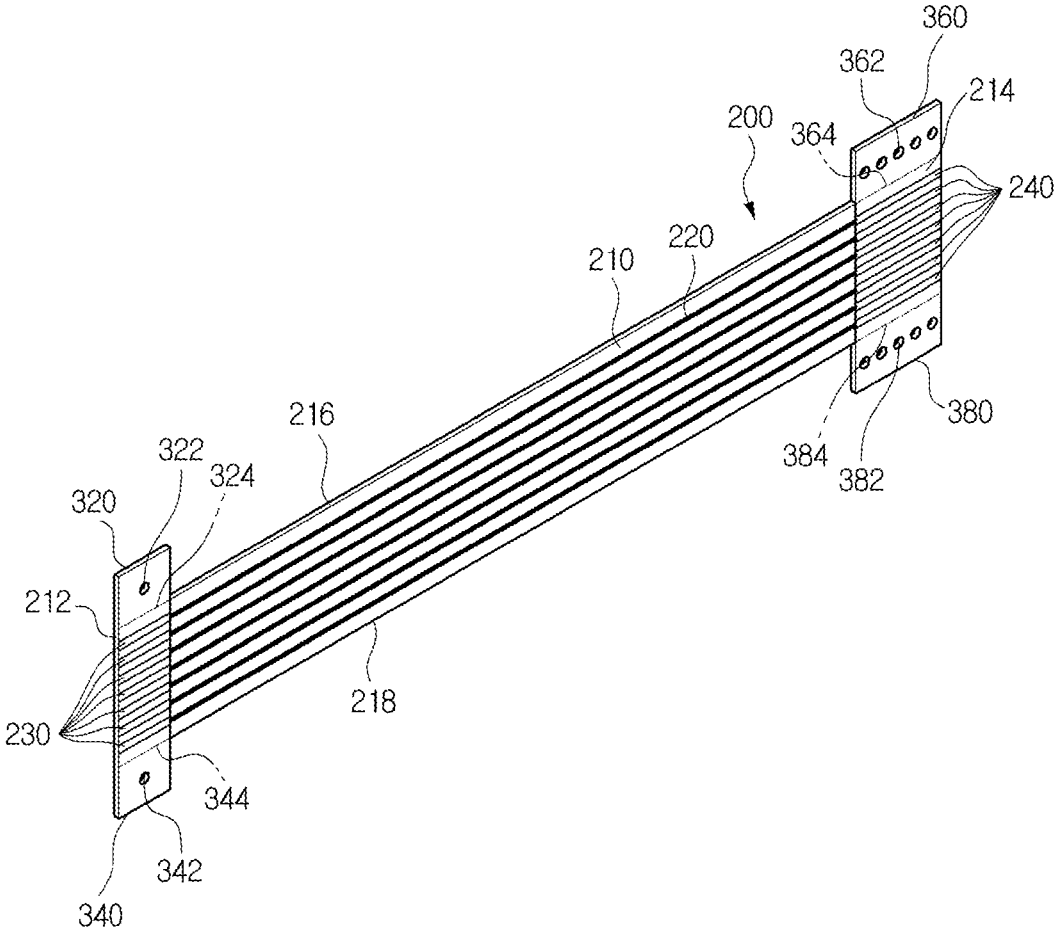

[FIG. 24]
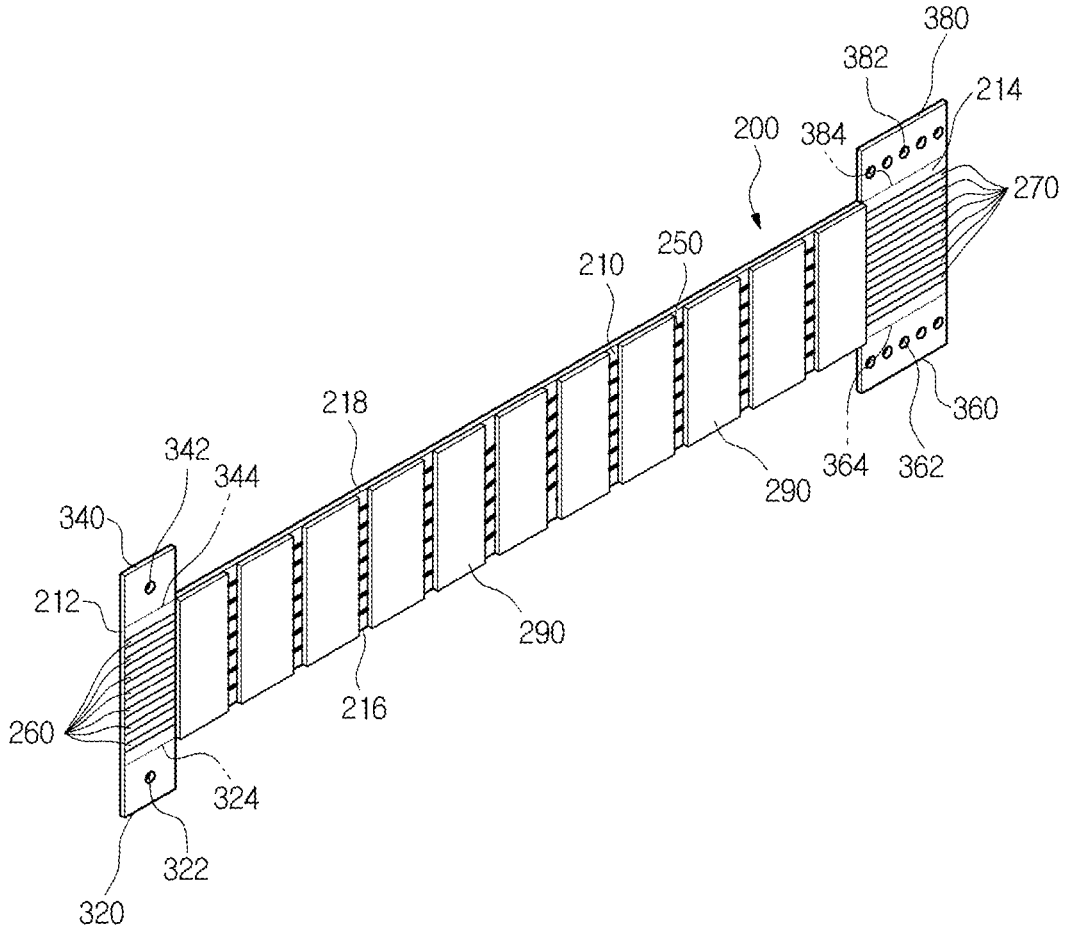

[FIG. 25]
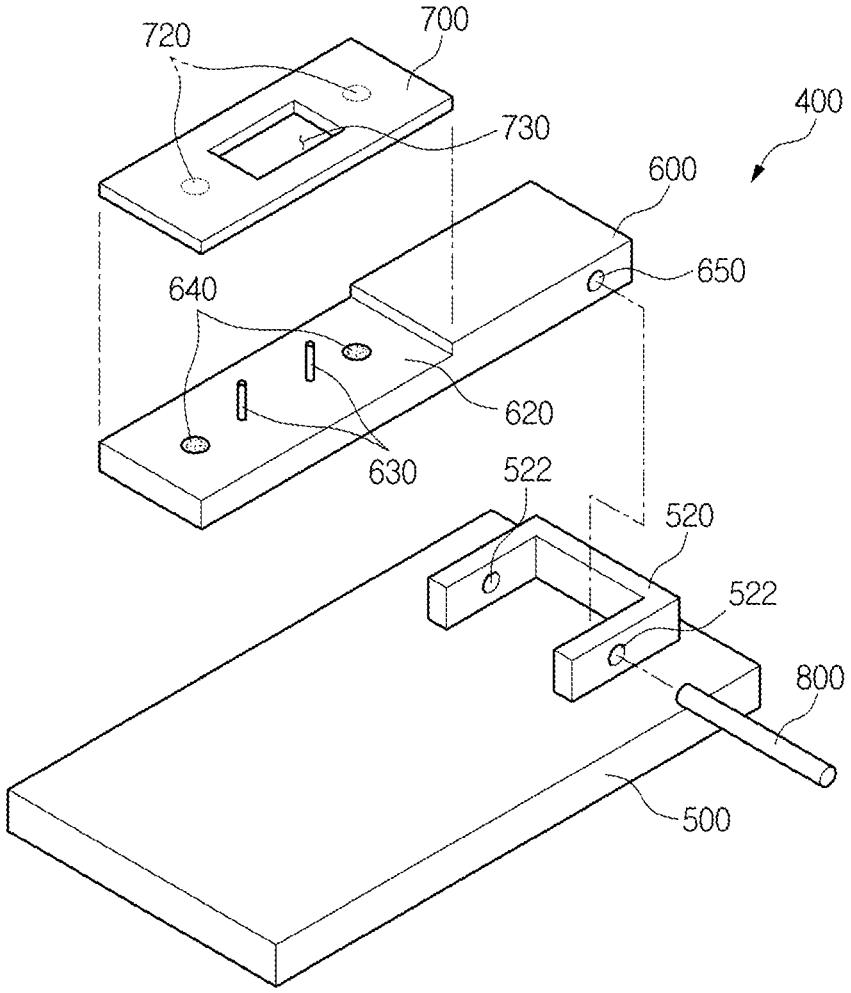

[FIG. 26]
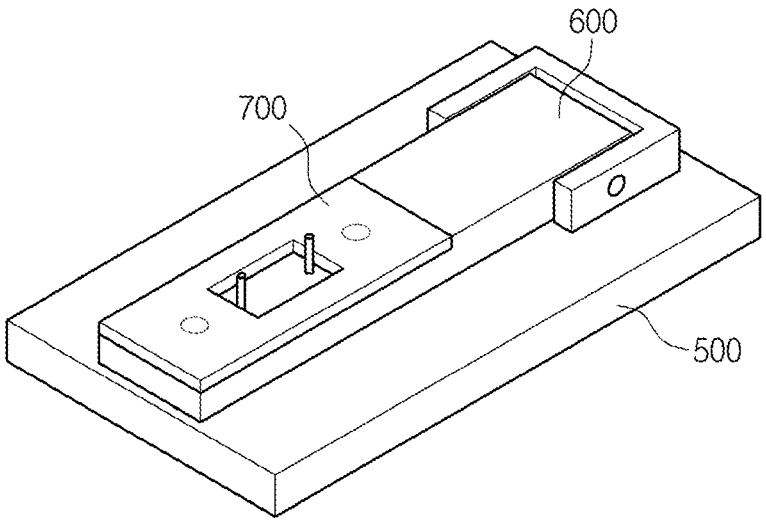
[FIG. 27]
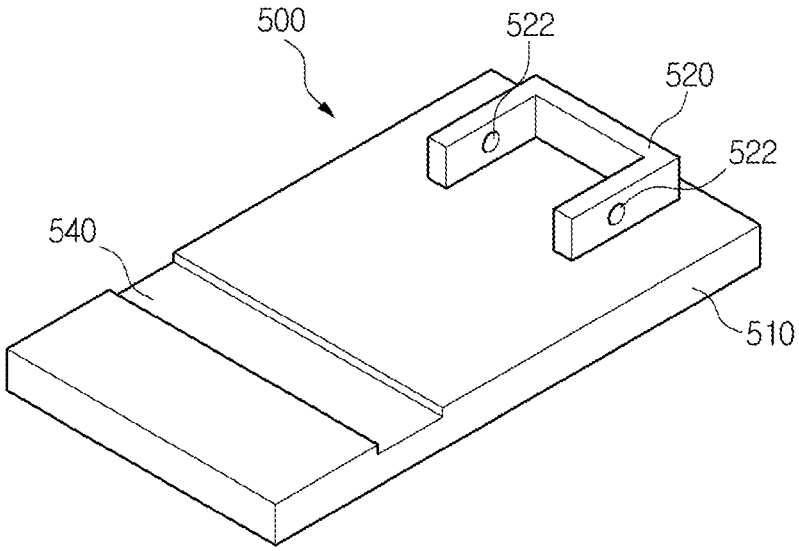

[FIG. 28]
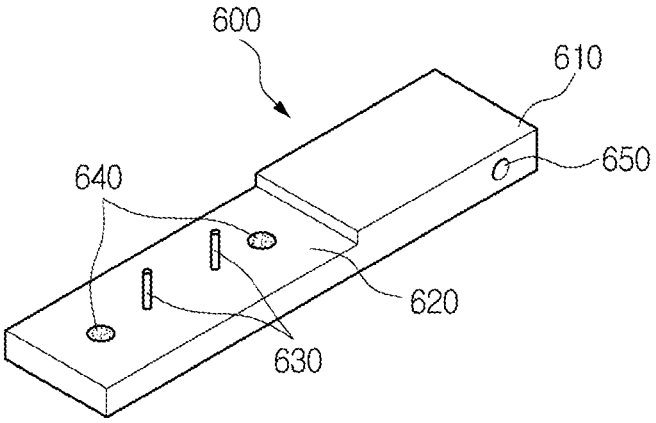
[FIG. 29]
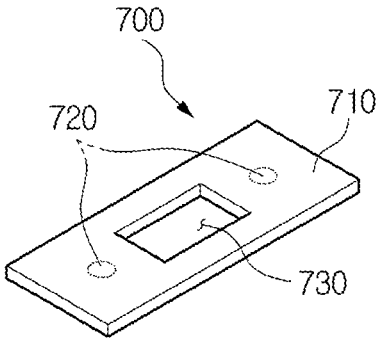

[FIG. 30]
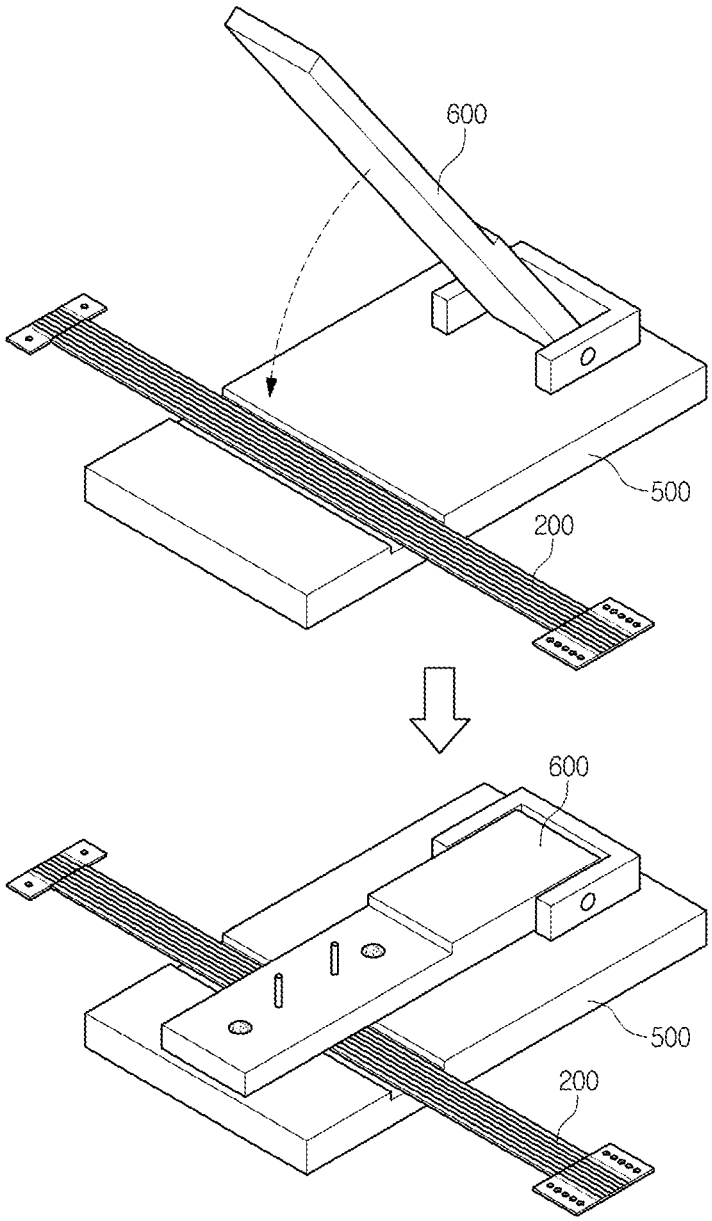

[FIG. 31]
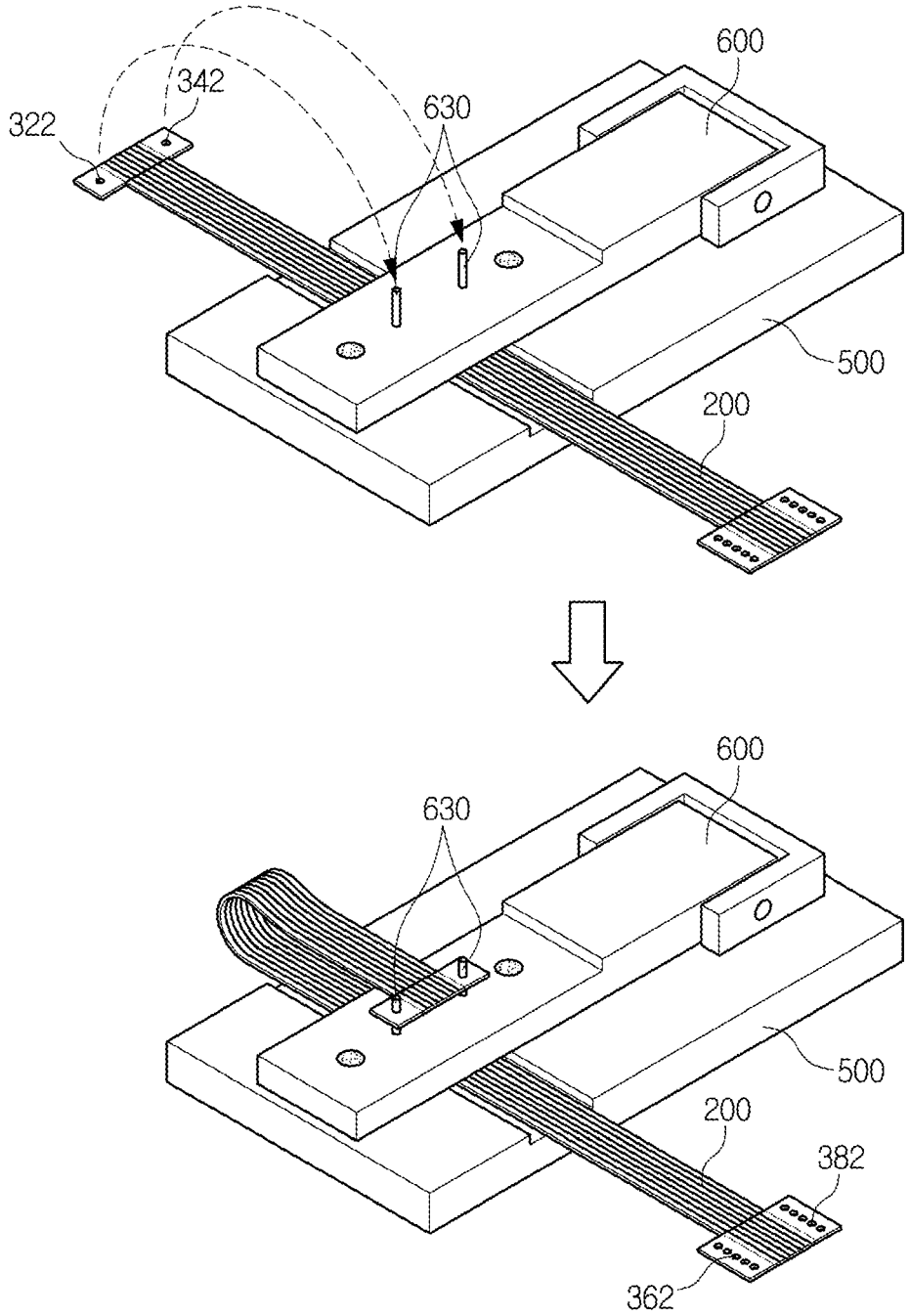

[FIG. 32]
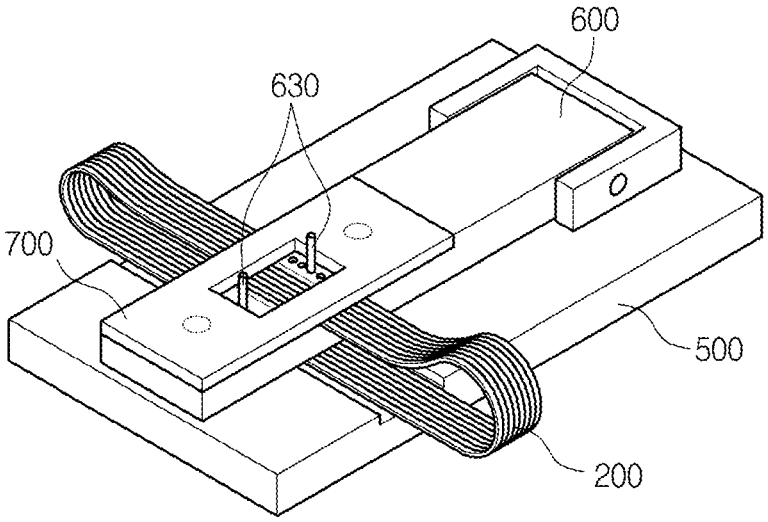

RING TYPE ANTENNA MODULE AND JIG FOR MANUFACTURING SAME

CROSS-REFERENCE TO RELATED APPLICATIONS

This application is a National Stage of International patent application PCT/KR2017/006031, filed on Jun. 9, 2017, which claims priority to foreign Korean patent application Nos. 10-2016-0078167 filed on Jun. 22, 2016, and 10-2016-0145884 filed on Nov. 3, 2016, the disclosures of which are incorporated by reference in their entireties.

FIELD OF THE INVENTION

The present disclosure relates to an antenna module for near-field communication, and more particularly, to a ring type antenna module and a jig for manufacture for manufacturing the same that are embedded in a ring type wearable device worn on a user's finger to perform near-field communication.

BACKGROUND

With the development of technology, a wearable device that controls a specific function in interlock with a smartphone or a tablet, or provides functions such as condition monitoring of a wearer and electronic payment is being developed.

In recent years, the wearable device has been manufactured in wearable form such as watches, goggles (glasses), clothes, and shoes. The wearable device exchanges data by performing near-field communication with the devices such as a portable terminal (e.g., a smart phone, a tablet) of a user and a POS terminal of a store. The wearable device provides functions such as a control of the corresponding terminal, electronic payment, door opening/closing, and attendance check through near-field communication with other terminals.

A smart watch is a wearable device that has recently become popular. The smart watch interlocks with a portable terminal of a user through near-field communication to control or execute some of the functions of the portable terminal, or to provide an electronic payment function through the near-field communication.

For example, there can be a Smart watch in Sony, a Gear in Samsung, an Apple watch in Apple, a G watch in LG, etc., and in addition to a basic clock function, these smart watches also have various functions such as checking and sending text messages, telephone, and electronic payment.

Meanwhile, a ring type wearable device embeds a Near-Field Communication (NFC) antenna module and performs near-field communication with other terminals. The ring type wearable device has a smaller number of functions than the smart watch, but has been attracting much attention due to low power consumption, a small size, and easy handling, such that the ring type wearable devices having various designs and functions are being developed.

For example, as illustrated in FIG. 1, a conventional ring type wearable device is formed in a structure that forms a mounting groove 12 in a ring main body 10 of a metal material and embeds a NFC antenna module 20 in the mounting groove.

However, there is a problem in that the conventional ring type wearable device is formed in a structure that embeds the NFC antenna module 20 in the mounting groove 12 of the ring main body 10 and then covers it with a cover, such that it can communicate with a target terminal only when a specific location (i.e., a location where the NFC antenna module 20 is embedded) is close to the target terminal, thus resulting in the user's inconvenience.

In addition, in the conventional ring type wearable device, the cover of the mounting groove 12 is often separated from the ring main body 10. In this case, there is a problem in that the NFC antenna module 20 mounted in the mounting groove 12 is exposed to the outside and is corroded or damaged, thus failing to perform the function thereof.

In order to solve the conventional problems, a ring type wearable device that can communicate regardless of a location (direction) close to a target terminal is required.

In addition, since a general planar type antenna module is hardly mounted on the ring type wearable device, the planar type antenna module is transformed into an arch shape having a predetermined curvature, or both ends of the planar type antenna module are bonded to be transformed into a ring shape.

For this purpose, the near-field communication antenna module forms a radiation pattern on a Flexible Printed Circuit Board (hereinafter, referred to as FPCB). The near-field communication antenna module is manufactured in a circular shape after bonding a ferrite sheet on one surface of the FPCB in order to prevent communication failure from occurring, and in this process, the ferrite sheet is damaged (broken) to generate powder, or wrinkles of the ferrite sheet are generated.

The ring type antenna module thus manufactured causes breakage and wrinkles of the ferrite sheet, resulting in problems such as deterioration in communication performance and communication failure due to a large dispersion of the antenna characteristics as well as a problem in appearance.

SUMMARY OF THE INVENTION

The present disclosure is intended to solve the above problems, and an object of the present disclosure is to provide a ring type antenna module and a jig for manufacture for manufacturing the same, which can communicate regardless of the orientation when mounted on the ring type wearable device and can easily process the size thereof.

In addition, another object of the present disclosure is to provide a ring type antenna module, which bonds a plurality of divided magnetic sheets spaced apart from each other to one surface of a base substrate having a radiation pattern formed thereon, thus preventing deterioration of antenna characteristics due to transformation of the ring shape of the base substrate.

In order to achieve the objects, a ring type antenna module in accordance with an embodiment of the present disclosure includes a base substrate having flexibility on which a radiation pattern is formed; a terminal part formed on one end of the base substrate and connected to one end of the radiation pattern; and the other terminal part formed on the other end of the base substrate and connected to the other end of the radiation pattern.

In this time, the terminal part can be formed on one surface and first short side of the base substrate, the other terminal part can be formed on the other surface and second short side of the base substrate, and the length of the other terminal part can be formed to be longer than that of the terminal part.

The ring type antenna module in accordance with an embodiment of the present disclosure can vary the radius of a ring shape by varying the contact location between the terminal part and the other terminal part when transforming the base substrate into the ring shape.

The base substrate can include a first radiation pattern formed on one surface of the base substrate; and a second radiation pattern formed on one surface of the base substrate.

The terminal part can include at least one of a first terminal part formed on one surface and first short side of the base substrate, and having one end connected to one end of the first radiation pattern; and a third terminal part formed on the other surface and the first short side of the base substrate, and having one end connected to one end of a second radiation pattern.

The other terminal part can include at least one of the second terminal part formed on one surface and second short side of the base substrate, and having one end connected to the other end of the first radiation pattern; and a fourth terminal part formed on the other surface and the second short side of the base substrate, and having one end connected to the other end of the second radiation pattern.

The ring type antenna module in accordance with an embodiment of the present disclosure can include a first guide part formed with one first guide hole, and formed on first long side and one end of the base substrate; a second guide part formed with one second guide hole, and formed on second long side and one end of the base substrate; a third guide part formed with a plurality of third guide holes, and formed on the first long side and the other end of the base substrate; and a fourth guide part formed with a plurality of fourth guide holes, and formed on the second long side and the other end of the base substrate. In this time, the first guide part to the fourth guide part can have a removal hole formed on the portion connected to the base substrate.

The ring type antenna module in accordance with an embodiment of the present disclosure can vary the contact location between the terminal part and the other terminal part by varying the third guide hole and the fourth guide hole that are in contact with the first guide hole and the second guide hole.

The ring type antenna module in accordance with an embodiment of the present disclosure can further include a magnetic sheet bonded to one surface of the base substrate, and the magnetic sheet can be a plurality of divided magnetic sheets that are spaced apart from each other and are bonded to one surface of the base substrate. In this time, the spacing distance between the divided magnetic sheet and the other divided magnetic sheet reduces toward the base substrate, and the divided magnetic sheet can have an inclined portion formed on at least one side surface of the side surfaces adjacent to the other divided magnetic sheet. Herein, the inclined portion has the spacing distance with the other divided magnetic sheet reducing toward the base substrate.

The divided magnetic sheet can include an adhesive layer having one surface adhered to the base substrate; a magnetic layer formed with an area narrower than the adhesive layer, and having one surface stacked on the other surface of the adhesive layer; and a protection layer formed with an area narrower than the magnetic layer, and stacked on the other surface of the magnetic layer.

A jig for manufacture for manufacturing a ring type antenna module in accordance with an embodiment of the present disclosure includes a lower fixing plate for supporting a ring type antenna module on the lower portion thereof; an upper fixing plate formed with a fixing pin into which a guide groove of the ring type antenna module is inserted, connected to the lower fixing plate, and for supporting the ring type antenna module on the upper portion thereof; and a separation fixing plate coupled to the upper portion of the upper fixing plate and for fixing the ring type antenna module inserted into the fixing pin.

In this time, the lower fixing plate can be formed with an insertion groove into which the ring type antenna module is inserted.

The upper fixing plate can include an upper main body for rotating around one end portion connected to the lower fixing plate, and a stepped coupling part formed on the other end portion of the upper main body, and having a step with the upper main body; and the stepped coupling part can be formed with a pair of fixing pins into which the guide groove of the ring type antenna module is inserted. In this time, the stepped coupling part can further include a first coupling member for maintaining the coupled state with the separation fixing plate.

The separation fixing plate can include a separation main body; and a second coupling member formed on the separation main body and for maintaining the coupled state with the upper main body. In this time, the separation main body can be formed with an exposure groove for exposing a part of the ring type antenna module inserted into the fixing pin.

According to the present disclosure, it is possible for the ring type antenna module to form a terminal part having different lengths on both ends thereof, and to vary the coupled location between the terminal parts when transformed into the ring shape, thus easily changing the size (radius) of the ring type antenna module.

In addition, it is possible for the ring type antenna module to change the size by varying the coupled location between the terminal parts formed on both ends thereof, thus manufacturing the ring type antenna module having various sizes using the planar type antenna module formed in a single standard.

In addition, it is possible for the ring type antenna module to change the size by varying the coupled location between the terminal parts formed on both ends thereof to simplify the manufacturing process to save the manufacturing cost, and to enhance productivity to secure economic efficiency, thus improving merchantability of the ring type antenna module.

In addition, it is possible for the ring type antenna module to connect the guide part on which the plurality of guide holes spaced apart from each other are formed to the terminal part formed on one end thereof, thus easily changing the size (radius) of the ring type antenna module by varying the guide hole.

In this time, it is possible for the ring type antenna module to form the removal hole on the portion where the guide part and the base substrate are connected to each other, thus easily removing an unnecessary guide part when mounted on the ring type wearable device.

In addition, it is possible for the ring type antenna module to bond the plurality of divided magnetic sheets spaced apart from each other to one surface of the base substrate having the radiation pattern formed thereon, thus preventing breakage and wrinkles of the magnetic sheet from occurring when transforming the base substrate into the ring shape.

In addition, it is possible for the ring type antenna module to bond the plurality of divided magnetic sheets spaced apart from each other to one surface of the base substrate having the radiation pattern formed thereon to prevent breakage and wrinkles of the magnetic sheet from occurring, thus preventing deterioration of the antenna characteristics when transforming the base substrate into the ring shape.

Meanwhile, the jig for manufacture for manufacturing the ring type antenna module is configured to include the upper fixing plate formed with the fixing pin into which the guide hole formed on the guide part of the ring type antenna module is inserted and the separation fixing plate for supporting the ring type antenna module inserted into the fixing pin, thus easily transforming the base substrate in the planar shape into the ring shape, and easily changing the size of the ring type antenna module by adjusting the guide hole inserted into the fixing pin.

In addition, the jig for manufacture for manufacturing the ring type antenna module is configured to include the upper fixing plate formed with the fixing pin into which the guide hole formed on the guide part of the ring type antenna module is inserted and the separation fixing plate for supporting the ring type antenna module inserted into the fixing pin, thus easily changing the size (radius) of the ring type antenna module and manufacturing it in an accurate size.

BRIEF DESCRIPTION OF THE DRAWINGS

FIG. 1 is a diagram for explaining a conventional ring type wearable device.

FIGS. 2 and 3 are diagrams for explaining a ring type wearable device to which a ring type antenna module is applied in accordance with a first embodiment of the present disclosure.

FIGS. 4 to 11 are diagrams for explaining the ring type antenna module in accordance with the first embodiment of the present disclosure.

FIGS. 12 to 14 are diagrams for explaining a ring type antenna module in accordance with a second embodiment of the present disclosure.

FIGS. 15 to 21 are diagrams for explaining a divided magnetic sheet of FIG. 1.

FIG. 22 is a diagram for explaining the ring type antenna module in accordance with an embodiment of the present disclosure.

FIGS. 23 and 24 are diagrams for explaining a transformation example of the ring type antenna module in accordance with an embodiment of the present disclosure.

FIGS. 25 to 32 are diagrams for explaining a jig for manufacture for manufacturing the ring type antenna module in accordance with an embodiment of the present disclosure.

DETAILED DESCRIPTION

Hereinafter, the most preferred embodiment of the present disclosure will be described with reference to the accompanying drawings so that those skilled in the art to which the present disclosure pertains can easily practice the technical spirit of the present disclosure. First, in adding reference numerals to the components in each drawing, it is to be noted that the same components are denoted by the same reference numerals even though they are illustrated in different drawings. In addition, in the following description of the present disclosure, a detailed description of known configurations or functions will be omitted when it is determined to obscure the subject matter of the present disclosure.

Referring to FIGS. 2 and 3, in order to solve the problems of the conventional ring type wearable device, a ring type wearable device 100 is configured to include a lower housing 120, a ring type antenna module 200, and an upper housing 140.

The lower housing 120 is formed with a protrusion part 122 inserted into the ring type antenna module 200. That is, the lower housing 120 is formed with the protrusion part 122 inserted into the inner circumference of the ring type antenna module 200 having a predetermined diameter and protruded upwards.

The ring type antenna module 200 is an antenna module mounted on the ring type wearable device 100 to perform near-field communication (i.e., NFC). The ring type antenna module 200 is formed of a flexible printed circuit board and is formed in a ring shape, and is mounted on the lower housing 120 so that the protrusion part 122 of the lower housing 120 is inserted into the inner circumference part thereof.

The upper housing 140 is formed in a ring shape having a predetermined thickness, width, and diameter. In this time, the upper housing 140 has one surface (i.e., lower surface) formed with an insertion groove 142 into which the protrusion part 122 of the lower housing 120 and the ring type antenna module 200 are inserted. Herein, the insertion groove 142 is formed in a ring shape having a thickness thinner than and a width narrower than the thickness and width of the upper housing 140.

The ring type wearable device 100 having such a configuration is manufactured by inserting and mounting the ring type antenna module 200 into the protrusion part 122 formed on the lower housing 120, and then coupling the lower housing 120 with the upper housing 140.

Since the ring type wearable device 100 is configured in a ring shape, it should be manufactured in various sizes (e.g., the size of the ring).

Accordingly, since the ring type antenna module 200 mounted on the ring type wearable device 100 is manufactured in various sizes (e.g., the size of the ring), productivity is deteriorated in the process of manufacturing various sizes of flexible circuit boards.

Accordingly, the ring type antenna module 200 in accordance with an embodiment of the present disclosure is formed to have a structure that can easily adjust the size (diameter) according to the size of the ring type wearable device 100.

Hereinafter, the ring type antenna module 200 in accordance with a first embodiment of the present disclosure will be described with reference to the accompanying drawings.

Referring to FIGS. 4 to 6, the ring type antenna module 200 is configured to include a base substrate 210, a first radiation pattern 220, a first terminal part 230, a second terminal part 240, a second radiation pattern 250, a third terminal part 260, a fourth terminal part 270, and a communication element 280.

The base substrate 210 is composed of a Flexible Printed Circuit Board (FPCB). That is, since the ring type antenna module 200 is formed in a ring shape, the base substrate 210 is composed of the Flexible Printed Circuit Board (FPCB) having flexibility in order to easily process it into a ring shape. In this time, since the base substrate 210 is formed in a ring shape, it can be composed of a rectangular shape having a first short side 212, a second short side 214, a first long side 216, and a second long side 218.

The first radiation pattern 220 is formed on one surface (i.e., the upper surface) of the base substrate 210. The first radiation pattern 220 is composed of a plurality of radiation lines formed to be spaced apart from each other on one surface of the base substrate 210. In this time, the plurality of radiation lines can be formed by vapor deposition, printing, plating, etc.

The first radiation pattern 220 has one end connected to the first terminal part 230, and has the other end connected to the second terminal part 240. That is, the plurality of radiation lines constituting the first radiation pattern 220 have one end connected to the first terminal part 230, and have the other end connected to the second terminal part 240.

The first terminal part 230 is formed on one surface of the base substrate 210. The first terminal part 230 is formed on one surface of the base substrate 210 that is the same as the first radiation pattern 220, and is composed of a plurality of terminal lines formed in a shape that is extended from the first short side 212 of the base substrate 210 toward the second short side 214 thereof.

In this time, the plurality of terminal lines are extended from the first short side 212 of the base substrate 210 toward the second short side 214 thereof, and are formed to have a predetermined length, and are formed to be spaced at a predetermined interval apart from each other. The plurality of terminal lines are one-to-one connected to one ends of the plurality of radiation lines constituting the first radiation pattern 220.

The second terminal part 240 is formed on one surface of the base substrate 210. The second terminal part 240 is formed on one surface of the base substrate 210 that is the same as the first radiation pattern 220 and the first terminal part 230, and is composed of a plurality of terminal lines formed in a shape that is extended from the second short side 214 of the base substrate 210 toward the first short side 212 thereof.

In this time, the plurality of terminal lines are extended from the second short side 214 of the base substrate 210 toward the first short side 212 thereof and are formed to have a predetermined length, and are formed to be spaced a predetermined interval apart from each other. The plurality of terminal lines are one-to-one connected to the other ends of the plurality of radiation lines constituting the first radiation pattern 220.

The second radiation pattern 250 is formed on the other surface (i.e., the lower surface) of the base substrate 210. The second radiation pattern is composed of a plurality of radiation lines formed to be spaced apart from each other on the other surface of the base substrate 210. In this time, the plurality of radiation lines can be formed by vapor deposition, printing, plating, etc. At least one of the plurality of radiation lines constituting the second radiation pattern 250 is electrically connected to the plurality of radiation lines constituting the first radiation pattern 220 through a connection member (not illustrated) such as a via hole.

The second radiation pattern 250 has one end connected to the third terminal part 260, and has the other end connected to the fourth terminal part 270. That is, the plurality of radiation lines constituting the second radiation pattern 250 have one end connected to the third terminal part 260, and have the other end connected to the fourth terminal part 270.

The third terminal part 260 is formed on the other surface of the base substrate 210. The third terminal part 260 is formed on the other surface of the base substrate 210 that is the same as the second radiation pattern 250, and is composed of a plurality of terminal lines formed in a shape that is extended from the first short side 212 of the base substrate 210 toward the second short side 214 thereof.

In this time, the plurality of terminal lines are extended from the first short side 212 of the base substrate 210 toward the second short side 214 thereof and are formed to have a predetermined length, and are formed to be spaced at a predetermined interval apart from each other. The plurality of terminal lines are one-to-one connected to one ends of the plurality of radiation lines constituting the second radiation pattern 250.

The fourth terminal part 270 is formed on the other surface of the base substrate 210. The fourth terminal part 270 is formed on one surface of the base substrate 210 that is the same as the second radiation pattern 250 and the third terminal part 260, and is composed of a plurality of terminal lines formed in a shape that is extended from the second short side 214 of the base substrate 210 toward the first short side 212 thereof.

In this time, the plurality of terminal lines are extended from the second short side 214 of the base substrate 210 toward the first short side 212 thereof and are formed to have a predetermined length, and are formed to be spaced at a predetermined interval apart from each other. The plurality of terminal lines are one-to-one connected to the other ends of the plurality of radiation lines constituting the second radiation pattern 250.

The communication element 280 is an element that is connected to the first radiation pattern 220 and the second radiation pattern 250 to process a signal. In this time, the communication element 280 can be coated with a protection layer 282.

As illustrated in FIG. 7, the ring type antenna module 200 of the above configuration is transformed from a planar shape into a ring shape, such that the first terminal part 230 and the fourth terminal part 270 (or the second terminal part 240 and the third terminal part 260) are coupled to each other.

In this time, since the ring type antenna module 200 should be manufactured in various sizes according to the size of the ring type wearable device 100 (e.g., the size and radius of the ring), the size of the ring type antenna module 200 is adjusted by adjusting the location where the first terminal part 230 (or the third terminal part 260) is coupled to the fourth terminal part 270 (or the second terminal part 240).

For this purpose, it is preferable that the ring type antenna module 200 is formed so that the length of the terminal line constituting the second terminal part 240 and the fourth terminal part 270 is longer than that of the terminal line constituting the first terminal part 230 and the third terminal part 260.

In addition, the ring type antenna module 200 has been described to include all of the first terminal part 230 to the fourth terminal part 270, but it is not limited thereto and can be configured to include only the first terminal part 230 and the fourth terminal part 270, or can be configured to include only the second terminal part 240 and the third terminal part 260. In this time, it is preferable that the ring type antenna module 200 is configured to include a pair of terminal parts formed on different surfaces of the base substrate 210.

In the ring type antenna module 200, the corresponding parts are connected by soldering in a state where the first terminal part 230 (or the third terminal part 260) has been coupled to the fourth ten final part 270 (or the second terminal part 240) to manufacture the ring type antenna module 200 having a radiation pattern in a ring shape.

Hereinafter, a ring type antenna module 200 in accordance with a second embodiment of the present disclosure will be described with reference to the accompanying drawings.

As illustrated in FIGS. 8 and 9, the ring type antenna module 200 is configured to include the base substrate 210, the first radiation pattern 220, the first terminal part 230, the second terminal part 240, the second radiation pattern 250, the third terminal part 260, the fourth terminal part 270, the communication element 280, a first guide part 320, a second guide part 340, a third guide part 360, and a fourth guide part 380. Herein, the base substrate 210, the first radiation pattern 220, the first terminal part 230, the second terminal part 240, the second radiation pattern 250, the third terminal part 260, the fourth terminal part 270, and the communication element 280 are the same as those in the first embodiment described above, such that their detailed descriptions will be omitted.

The first guide part 320 is formed on one side portion of the first long side 216 of the base substrate 210. The first guide part 320 is formed of the same material as the base substrate 210, and is formed to be extended from one side portion of the first long side 216 of the base substrate 210 (i.e., toward the first short side 212) toward the outside. In this time, the first guide part 320 is formed with a first guide hole 322 for coupling to a jig for manufacture 400 that is used for coupling the ring type antenna module 200 in a ring shape.

The first guide part 320 is removed after coupling the ring type antenna module 200 in a ring shape, and for this purpose, a plurality of first removal holes 324 for cutting the first guide part 320 can be formed on the portion connected to the base substrate 210. Herein, when the first guide part 320 can be removed from the base substrate 210, it is applicable other than the removal hole.

The second guide part 340 is formed on one side portion of the second long side 218 of the base substrate 210. The second guide part 340 is formed of the same material as the base substrate 210, and is formed to be extended from one side portion of the second long side 218 of the base substrate 210 (i.e., toward the first short side 212) toward the outside. In this time, the second guide part 340 is formed with a second guide hole 342 for coupling to the jig for manufacture 400 that is used for coupling the ring type antenna module 200 in a ring shape.

The second guide part 340 is removed after coupling the ring type antenna module 200 in a ring shape, and for this purpose, a plurality of second removal holes 344 for cutting the second guide part 340 can be formed on the portion connected to the base substrate 210. Herein, when the second guide part 340 can be removed from the base substrate 210, it is applicable other than the removal hole.

The third guide part 360 is formed on the other side portion of the first long side 216 of the base substrate 210. The third guide part 360 is formed of the same material as the base substrate 210, and is formed to be extended from the other side portion of the first long side 216 of the base substrate 210 (i.e., toward the second short side 214) toward the outside. In this time, the third guide part 360 is formed with a plurality of third guide holes 362 for coupling to the jig for manufacture 400 that is used for coupling the ring type antenna module 200 in a ring shape.

The third guide part 360 is removed after coupling the ring type antenna module 200 in a ring shape, and for this purpose, a plurality of third removal holes 364 for cutting the third guide part 360 can be formed on the portion connected to the base substrate 210. Herein, when the third guide part 360 can be removed from the base substrate 210, it is applicable other than the removal hole.

The fourth guide part 380 is formed on the other side portion of the second long side 218 of the base substrate 210. The fourth guide part 380 is formed of the same material as the base substrate 210, and is formed to be extended from the other side portion of the second long side 218 of the base substrate 210 (i.e., toward the second short side 214) toward the outside. In this time, the fourth guide part 380 is formed with a plurality of fourth guide holes 382 for coupling to the jig for manufacture 400 that is used for coupling the ring type antenna module 200 in a ring shape.

The fourth guide part 380 is removed after coupling the ring type antenna module 200 in a ring shape, and for this purpose, a plurality of fourth removal holes 384 for cutting the fourth guide part 380 can be formed on the portion connected to the base substrate 210. Herein, when the fourth guide part 380 can be removed from the base substrate 210, it is applicable other than the removal hole.

The ring type antenna module 200 of the above configuration is transformed from a planar shape into a ring shape by coupling the first terminal part 230 and the fourth terminal part 270 (or the second terminal part 240 and the third terminal part 260).

In this time, since the ring type antenna module 200 should be manufactured in various sizes according to the size of the ring type wearable device 100 (e.g., the size of the ring), the size of the ring type antenna module 200 is adjusted by adjusting the location where the first terminal part 230 (or the third terminal part 260) is coupled to the fourth terminal part 270 (or the second terminal part 240).

As illustrated in FIG. 10, the ring type antenna module 200 is manufactured by using the jig for manufacture 400 in order to easily adjust the size of the ring type antenna module 200.

In the ring type antenna module 200, the first guide hole 322 and the second guide hole 342 are inserted into and fixed to fixing pins 420, 440 of the jig for manufacture 400, and then one of the plurality of third guide holes 362 and one of the plurality of fourth guide holes 382, which are selected according to the size, are inserted into the fixing pins 420, 440. Herein, the size of the ring type antenna module 200 is changed by changing the third guide hole 362 and the fourth guide hole 382 inserted into the fixing pins 420, 440 of the jig for manufacture 400.

Accordingly, the ring type antenna module 200 maintains the state where the first terminal part 230 (or the third terminal part 260) has been coupled to the fourth terminal part 270 (or the second terminal part 240), and is manufactured in a ring shape by connecting the corresponding portions through soldering.

As described above, it is possible for the ring type antenna module to form a terminal part having different lengths on both ends thereof, and to vary the coupled location between the terminal parts when transformed into the ring shape, thus easily changing the size (diameter) of the ring type antenna module.

In addition, it is possible for the ring type antenna module to change the size by varying the coupled location between the terminal parts formed on both ends thereof, thus manufacturing the ring type antenna module having various sizes using the planar type antenna module formed in a single standard.

In addition, it is possible for the ring type antenna module to change the size by varying the coupled location between the terminal parts formed on both ends thereof to simplify the manufacturing process to save the manufacturing cost, and to enhance productivity to secure economic efficiency, thus improving merchantability of the ring type antenna module.

In addition, it is possible for the ring type antenna module to connect the guide part on which the plurality of guide holes spaced apart from each other are formed to the terminal part formed on one end thereof, thus easily changing the size (diameter) of the ring type antenna module by varying the guide hole.

In this time, it is possible for the ring type antenna module to form the removal hole on the portion where the guide part and the base substrate are connected to each other, thus easily removing an unnecessary guide part when mounted on the ring type wearable device.

Referring to FIGS. 12 to 14, the ring type antenna module 200 is configured to include the base substrate 210, the first radiation pattern 220, the second radiation pattern 250, the first terminal part 230, the second terminal part 240, the third terminal part 260, the fourth terminal part 270, and a plurality of divided magnetic sheets 290.

The base substrate 210 is composed of a Flexible Printed Circuit Board (FPCB). That is, the ring type antenna module 200 is formed in a ring shape, such that the base substrate 210 is composed of a Flexible Printed Circuit Board (FPCB) having flexibility in order to easily process it into a ring shape. In this time, the base substrate 210 is formed in a ring shape, such that it can be formed in a rectangular shape having the first short side 212, the second short side 214, the first long side 216, and the second long side 218.

The first radiation pattern 220 is formed on one surface (i.e., the upper surface) of the base substrate 210. The first radiation pattern 220 is composed of a plurality of radiation lines formed to be spaced apart from each other on one surface of the base substrate 210. In this time, the plurality of radiation lines can be formed by vapor deposition, printing, plating, etc.

The second radiation pattern 250 is formed on the other surface (i.e., the lower surface) of the base substrate 210. The second radiation pattern is composed of a plurality of radiation lines formed to be spaced apart from each other on the other surface of the base substrate 210. In this time, the plurality of radiation lines can be formed by vapor deposition, printing, plating, etc.

At least one of the plurality of radiation lines constituting the second radiation pattern 250 is electrically connected to the plurality of radiation lines constituting the first radiation pattern 220 through a connection member (not illustrated) such as a via hole.

The first terminal part 230 is formed on one surface of the base substrate 210. The first terminal part 230 is formed on one surface of the base substrate 210 that is the same as the first radiation pattern 220, and is composed of a plurality of terminal lines formed in a shape that is extended from the first short side 212 of the base substrate 210 toward the second short side 214 thereof.

In this time, the plurality of terminal lines are extended from the first short side 212 of the base substrate 210 toward the second short side 214 thereof and are formed to have a predetermined length, and are formed to be spaced at a predetermined interval apart from each other. The plurality of terminal lines are one-to-one connected to one ends of the plurality of radiation lines constituting the first radiation pattern 220.

The second terminal part 240 is formed on one surface of the base substrate 210. The second terminal part 240 is formed on one surface of the base substrate 210 that is the same as the first radiation pattern 220 and the first terminal part 230, and is composed of a plurality of terminal lines formed in a shape that is extended from the second short side 214 of the base substrate 210 toward the first short side 212 thereof.

In this time, the plurality of terminal lines are extended from the second short side 214 of the base substrate 210 toward the first short side 212 thereof and are formed to have a predetermined length, and are formed to be spaced at a predetermined interval apart from the each other. The plurality of terminal lines are one-to-one connected to the other ends of the plurality of radiation lines constituting the first radiation pattern 220.

The third terminal part 260 is formed on the other surface of the base substrate 210. The third terminal part 260 is formed on the other surface of the base substrate 210 that is the same as the second radiation pattern 250, and is composed of a plurality of terminal lines formed in a shape that is extended from the first short side 212 of the base substrate 210 toward the second short side 214 thereof.

In this time, the plurality of terminal lines are extended from the first short side 212 of the base substrate 210 toward the second short side 214 thereof and are formed to have a predetermined length, and are formed to be spaced at a predetermined interval apart from each other. The plurality of terminal lines are one-to-one connected to one ends of the plurality of radiation lines constituting the second radiation pattern 250.

The fourth terminal part 270 is formed on the other surface of the base substrate 210. The fourth terminal part 270 is formed on one surface of the base substrate 210 that is the same as the second radiation pattern 250 and the third terminal part 260, and is composed of a plurality of terminal lines formed in a shape that is extended from the second short side 214 of the base substrate 210 toward the first short side 212 thereof.

In this time, the plurality of terminal lines are extended from the second short side 214 of the base substrate 210 toward the first short side 212 and are formed to have a predetermined length, and are formed to be spaced at a predetermined interval apart from each other. The plurality of terminal lines are one-to-one connected to the other ends of the plurality of radiation lines constituting the second radiation pattern 250.

In this time, two terminal parts formed on different surfaces of the base substrate 210 among the first terminal part 230 to the fourth terminal part 270 can be also formed on the base substrate 210.

The divided magnetic sheet 290 is bonded to one surface of the base substrate 210. That is, the divided magnetic sheet 290 is bonded to one surface of the base substrate 210 on which the first radiation pattern 220 is formed, or to the other surface of the base substrate 210 on which the second radiation pattern 250 is formed.

The divided magnetic sheet 290 is spaced at a predetermined interval apart from the other divided magnetic sheet 290 to be bonded to the base substrate 210. That is, a plurality of divided magnetic sheets 290 are bonded to the base substrate 210, and the plurality of divided magnetic sheets 290 are spaced at a predetermined interval apart from each other. In this time, it is preferable that the divided magnetic sheet 290 is bonded to one surface located on the inner circumference portion thereof when transforming the base substrate 210 into a ring shape.

Referring to FIG. 15, when the divided magnetic sheet 290 has both side surfaces adjacent to the other divided magnetic sheet 290 formed in parallel, the edges of the divided magnetic sheet 290 can be collided and damaged according to the thickness of the divided magnetic sheet 290 when transformed into a ring shape. In this time, FIG. 15 illustrates that it is larger and thicker than the actual size for ease of explanation, but the actual product is not limited thereto and can be formed to be smaller and thinner than the size illustrated therein.

In this time, it is possible to increase the spacing distance between the divided magnetic sheets 290, thus preventing breakage of the divided magnetic sheet 290 upon transformation, but when the spacing distance therebetween increases, the shielding of the magnetic field cannot be normally performed, resulting in deterioration of antenna performance.

Accordingly, the divided magnetic sheet 290 can have at least one side surface of both side surfaces adjacent to the other divided magnetic sheet 290 formed with inclined portions. In this time, the divided magnetic sheet 290 can be formed in a trapezoid shape in which the lower side has a length longer than the upper side in the vertical cut surface, and can be formed with an inclined portion having the spacing distance with the other divided magnetic sheet 290 decreased toward the base substrate 210.

For example, that is, referring to FIG. 16, the divided magnetic sheet 290 has both side surfaces adjacent to the other divided magnetic sheet 290 formed with the inclined portions. In this time, the inclined portion is formed to have the inclination that the spacing distance between the divided magnetic sheet 290 and the other divided magnetic sheet 290 decreases toward the base substrate 210.

For another example, referring to FIG. 17, the divided magnetic sheet 290 is formed with the inclined portion on one side surface adjacent to the other divided magnetic sheet 290. In this time, when the inclined portions are formed on different side surfaces of the divided magnetic sheets 290 and the side surfaces on which the inclined portions are not formed are adjacent to each other, breakage thereof is caused upon transformation, such that it is preferable that the divided magnetic sheets 290 have the inclined portion formed on the same one side surface thereof.

Referring to FIGS. 18 and 19, the divided magnetic sheet 290 can be configured to include an adhesive layer 292, a magnetic layer 294, and a protection layer 296.

The adhesive layer 292 has one surface adhered to the base substrate 210. In this time, the adhesive layer 292 is composed of an adhesive sheet such as a double-sided tape.

The magnetic layer 294 has one surface stacked on the other surface of the adhesive layer 292. That is, the magnetic layer 294 has one surface adhered to the other surface of the adhesive layer 292. In this time, the magnetic layer 294 is composed of a magnetic sheet such as a ferrite sheet and is formed to have an area narrower than the adhesive layer 292.

The protection layer 296 is stacked on the other surface of the magnetic layer 294 to protect the magnetic layer 294. In this time, the protection layer 296 is formed to have an area narrower than the magnetic layer 294.

In this time, as the adhesive layer 292, the magnetic layer 294, and the protection layer 296 are formed of flat plates having different areas and sequentially stacked, the divided magnetic sheet 290 has the inclined portion formed on at least one side surface of both side surfaces adjacent to the other divided magnetic sheet 290.

Referring to FIGS. 20 and 21, the adhesive layer 292, the magnetic layer 294, and the protection layer 296 can have inclination formed on at least one side surface of both side surfaces thereof. In this time, when the inclined portion is formed on only one side surface of the divided magnetic sheet 290, the adhesive layer 292, the magnetic layer 294, and the protection layer 296 have inclination formed on the same one side surfaces thereof.

Meanwhile, it has been described in the above description that the divided magnetic sheet 290 is bonded to one surface of the base substrate 210, but when it can be formed to have a thickness of a certain level or more, it can be composed of a single ferrite sheet, or can be also composed of a flexible polymer sheet.

Referring to FIG. 22, the ring type antenna module 200 of the above configuration is transformed from a planar shape into a ring shape, such that the first terminal part 230 and the fourth terminal part 270 (or the second terminal part 240 and the third terminal part 260) are coupled to each other.

In this time, since the ring type antenna module 200 should be manufactured in various sizes according to the size of the ring type wearable device (e.g., the size and radius of the ring), the size of the ring type antenna module 200 is adjusted by adjusting the location where the first terminal part 230 (or the third terminal part 260) is coupled to the fourth terminal part 270 (or the second terminal part 240).

For this purpose, it is preferable that the ring type antenna module 200 is formed so that the length of the terminal line constituting the second terminal part 240 and the fourth terminal part 270 is longer than that of the terminal line constituting the first terminal part 230 and the third terminal part 260.

In addition, it has been described that the ring type antenna module 200 includes all of the first terminal part 230 to the fourth terminal part 270, but it is not limited thereto and can be configured to include only the first terminal part 230 and the fourth terminal part 270, or can be configured to include only the second terminal part 240 and the third terminal part 260. In this time, it is preferable that the ring type antenna module 200 is configured to include a pair of terminal parts formed on different surfaces of the base substrate 210.

In the ring type antenna module 200, the corresponding portions are connected by soldering in a state where the first terminal part 230 (or the third terminal part 260) has been coupled to the fourth terminal part 270 (or the second terminal part 240) to manufacture the ring type antenna module 200 having the radiation pattern in a ring shape.

Meanwhile, referring to FIGS. 23 and 24, the ring type antenna module 200 can further include the first guide part 320, the second guide part 340, the third guide part 360, and the fourth guide part 380.

The first guide part 320 is formed on one side portion of the first long side 216 of the base substrate 210. The first guide part 320 is formed of the same material as the base substrate 210, and is formed to be extended from one side portion of the first long side 216 of the base substrate 210 (i.e., toward the first short side 212) toward the outside. In this time, the first guide part 320 is formed with the first guide hole 322 for coupling to the jig for manufacture (not illustrated) that is used for coupling the ring type antenna module 200 in a ring shape.

The first guide part 320 is removed after coupling the ring type antenna module 200 in a ring shape, and for this purpose, the plurality of first removal holes 324 for cutting the first guide part 320 can be formed on the portion connected to the base substrate 210. Herein, when the first guide part 320 can be removed from the base substrate 210, it is applicable other than the removal hole.

The second guide part 340 is formed on one side portion of the second long side 218 of the base substrate 210. The second guide part 340 is formed of the same material as the base substrate 210, and is formed to be extended from one side portion of the second long side 218 of the base substrate 210 (i.e., toward the first short side 212) toward the outside. In this time, the second guide part 340 is formed with the second guide hole 342 for coupling to the jig for manufacture (not illustrated) that is used for coupling the ring type antenna module 200 in a ring shape.

The second guide part 340 is removed after coupling the ring type antenna module 200 in a ring shape, and for this purpose, the plurality of second removal holes 344 for cutting the second guide part 340 can be formed on the portion connected to the base substrate 210. Herein, when the second guide part 340 can be removed from the base substrate 210, it is applicable other than the removal hole.

The third guide part 360 is formed on the other side portion of the first long side 216 of the base substrate 210. The third guide part 360 is formed of the same material as the base substrate 210, and is formed to be extended from the other side portion of the first long side 216 of the base substrate 210 (i.e., toward the second short side 214) toward the outside. In this time, the third guide part 360 is formed with the plurality of third guide holes 362 for coupling to the jig for manufacture (not illustrated) that is used for coupling the ring type antenna module 200 in a ring shape.

The third guide part 360 is removed after coupling the ring type antenna module 200 in a ring shape, and for this purpose, the plurality of third removal holes 364 for cutting the third guide part 360 can be formed on the portion connected to the base substrate 210. Herein, when the third guide part 360 can be removed from the base substrate 210, it is applicable other than the removal hole.

The fourth guide part 380 is formed on the other side portion of the second long side 218 of the base substrate 210. The fourth guide part 380 is formed of the same material as the base substrate 210, and is formed to be extended from the other side portion of the second long side 218 of the base substrate 210 (i.e., toward the second short side 214) toward the outside. In this time, the fourth guide part 380 is formed with the plurality of fourth guide holes 382 for coupling to the jig for manufacture (not illustrated) that is used for coupling the ring type antenna module 200 in a ring shape.

The fourth guide part 380 is removed after coupling the ring type antenna module 200 in a ring shape, and for this purpose, the plurality of fourth removal holes 384 for cutting the fourth guide part 380 can be formed on the portion connected to the base substrate 210. Herein, when the fourth guide part 380 can be removed from the base substrate 210, it is applicable other than the removal hole.

The ring type antenna module 200 of the above configuration is transformed from a planar shape into a ring shape by coupling the first terminal part 230 and the fourth terminal part 270 (or the second terminal part 240 and the third terminal part 260).

In this time, since the ring type antenna module 200 should be manufactured in various sizes according to the size of the ring type wearable device (e.g., the size of the ring), the size of the ring type antenna module 200 is adjusted by adjusting the location where the first terminal part 230 (or the third terminal part 260) is coupled to the fourth terminal part 270 (or the second terminal part 240).

A jig for manufacture for manufacturing the ring type antenna module in accordance with an embodiment of the present disclosure will be described with reference to the accompanying drawings.

Referring to FIGS. 25 and 26, the jig for manufacture 400 for manufacturing the ring type antenna module 200 is configured to include a lower fixing plate 500, an upper fixing plate 600, and a separation fixing plate 700.

The lower fixing plate 500 is formed in a flat plate shape, and fixes one surface of the ring type antenna module 200 located on the upper portion thereof. The lower fixing plate 500 is coupled to one end of the upper fixing plate 600 to form a hinge coupling member 520 so that the upper fixing plate 600 can rotate.

For example, the lower fixing plate 500 is formed with the hinge coupling member 520 formed on a pin insertion hole 522 on one surface of a lower main body 510. After a pin insertion hole 650 of the upper fixing plate 600 is located to be the same line as the pin insertion hole 522 of the hinge coupling member 520, a coupling pin 800 is inserted therein to penetrate the hinge coupling member 520 and the pin insertion hole 650 of the upper fixing plate 600. The pin insertion hole 650 of the upper fixing plate 600 is formed to have a diameter larger than the pin insertion hole 522 of the hinge coupling member 520 and is coupled to the lower fixing plate 500 so that the upper fixing plate 600 can rotate around the coupling pin 800.

As illustrated in FIG. 27, the lower fixing plate 500 can be formed with an insertion groove 540 in order to easily fix and locate the ring type antenna module 200. In this time, the insertion groove 540 is formed from one side portion of the lower fixing plate 500 to the other side portion thereof. The insertion groove 540 can be formed to have a width wider than the width (i.e., the width of the short side) of the ring type antenna module 200, and can be formed to have a depth equal to or greater than the thickness of the ring type antenna module 200.

Herein, the insertion groove 540 can be also formed only on a part of the lower fixing plate 500, which is in contact with the upper fixing plate 600.

The upper fixing plate 600 has one side coupled to the hinge coupling member 520 formed on the lower fixing plate 500. The upper fixing plate 600 rotates around one side coupled to the lower fixing plate 500. The upper fixing plate 600 rotates toward the lower fixing plate 500 in a state where the ring type antenna module 200 is located on the lower fixing plate 500 to fix the other surface of the ring type antenna module 200.

For this purpose, as illustrated in FIG. 28, the upper fixing plate 600 is configured to include an upper main body 610; a stepped coupling part 620 to which a separation fixing plate 700 is coupled by forming a step of a predetermined height (e.g., the thickness of the separation fixing plate 700) on one end of the upper main body 610; a pair of fixing pins 630 formed on the stepped coupling part 620 and inserted into the first guide hole 322 to the fourth guide hole 382 of the ring type antenna module 200, and for fixing the ring type antenna module 200; and a first coupling member 640 for the coupling with the separation fixing plate 700.

In this time, the first coupling member 640 can be any member at its convenience as long as it can maintain the coupled state with the separation fixing plate 700, such as unevenness or magnet.

The separation fixing plate 700 fixes the ring type antenna module 200 coupled to the stepped coupling part 620 of the upper fixing plate 600. That is, the separation fixing plate 700 is coupled to the stepped coupling part 620 of the upper fixing plate 600 in a state where the guide holes of the ring type antenna module 200 are inserted into the fixing pins 630 of the upper fixing plate 600 to fix the ring type antenna module 200.

For this purpose, as illustrated in FIG. 29, the separation fixing plate 700 is formed with a second coupling member 720 on the separation main body 710 in order to maintain the coupled state with the stepped coupling part 620, and is formed with an exposure hole 730 for exposing the terminal part of the ring type antenna module 200.

Herein, as the guide holes are inserted into the fixing pins 630, the ring shape can be maintained by soldering the terminal portions in a state where the terminal parts of the ring type antenna module 200 are coupled to each other to form the ring shape. Accordingly, the exposed hole 730 exposes a part of the ring type antenna module 200 (i.e., the portion to which the terminal parts are coupled) so that the terminal part of the ring type antenna module 200 can be soldered.

Hereinafter, a method of manufacturing the ring type antenna module 200 using the jig for manufacture 400 will be described with reference to FIGS. 30 to 32.

As illustrated in FIG. 30, the ring type antenna module 200 in a planar shape is inserted into the insertion groove 540 in a state where the upper fixing plate 600 that the separation fixing plate 700 is separated rotates upwards. Thereafter, the upper fixing plate 600 rotates downwards to fix the ring type antenna module 200.

As illustrated in FIG. 31, the first guide hole 322 and the second guide hole 342 of the ring type antenna module 200 are inserted into the fixing pins 630, and then the third guide hole 362 and the fourth guide hole 382 are inserted into the fixing pins 630.

Of course, the third guide hole 362 and the fourth guide hole 382 of the ring type antenna module 200 can be inserted into the fixing pins 630, and then the first guide hole 322 and the second guide hole 342 can be inserted into the fixing pins 630.

In this time, the ring type antenna module 200 can be separated from the fixing pin 630 by elasticity of the ring type antenna module 200 in a state where the guide holes of the ring type antenna module 200 are inserted into the fixing pins 630.

Accordingly, as illustrated in FIG. 32, it is possible to couple the separation fixing plate 700 to the upper fixing plate 600 to fix the coupled portion of the ring type antenna module 200 on the upper portion thereof, thus preventing the ring type antenna module 200 from being separated therefrom.

Thereafter, the terminal parts of the ring type antenna module 200 exposed through the exposure hole 730 of the separation fixing plate 700 are soldered to constitute a radiation pattern in a ring shape, and the above processes are performed in reverse order to separate the ring type antenna module 200 from the jig for manufacture 400.

Finally, the guide part of the ring type antenna module 200 separated from the jig for manufacture 400 is removed to manufacture the ring type antenna module 200 in a final state (see FIG. 11).

As described above, the jig for manufacture for manufacturing the ring type antenna module is configured to include the upper fixing plate formed with the fixing pin into which the guide hole formed on the guide part of the ring type antenna module is inserted and the separation fixing plate for supporting the ring type antenna module inserted into the fixing pin, thus easily transforming the base substrate in the planar shape into the ring shape, and easily changing the size of the ring type antenna module by adjusting the guide hole inserted into the fixing pin.

In addition, the jig for manufacture for manufacturing the ring type antenna module is configured to include the upper fixing plate formed with the fixing pin into which the guide hole formed on the guide part of the ring type antenna module is inserted and the separation fixing plate for supporting the ring type antenna module inserted into the fixing pin, thus easily changing the size (radius) of the ring type antenna module and manufacturing it in an accurate size.

As described above, although preferred embodiments of the present disclosure have been described, it is to be understood that they can be modified into various forms, and various modifications and changes thereof can be embodied by those skilled in the art to which the present disclosure pertains without departing from the scope of the present disclosure.

The invention claimed is:

1. A ring type antenna module, comprising:

a base substrate having flexibility on which a radiation pattern is formed;

a terminal part formed on one end of the base substrate and connected to one end of the radiation pattern;

the other terminal part formed on the other end of the base substrate and connected to the other end of the radiation pattern;

a first guide part formed with one first guide hole, and formed on first long side and one end of the base substrate;

a second guide part formed with one second guide hole, and formed on second long side and one end of the base substrate;

a third guide part formed with a plurality of third guide holes, and formed on the first long side and the other end of the base substrate; and a fourth guide part formed with a plurality of fourth guide holes, and formed on the second long side and the other end of the base substrate.

2. The ring type antenna module of claim 1, wherein the terminal part is formed on one surface and first short side of the base substrate, wherein the other terminal part is formed on the other surface and second short side of the base substrate, and wherein the length of the other terminal part is formed to be longer than that of the terminal part.

3. The ring type antenna module of claim 1, wherein the radius in a ring shape varies by varying the contact location between the terminal part and the other terminal part when transforming the base substrate into the ring shape.

4. The ring type antenna module of claim 1, wherein the base substrate comprises a first radiation pattern formed on one surface of the base substrate; and a second radiation pattern formed on one surface of the base substrate.

5. The ring type antenna module of claim 4, wherein the terminal part comprises at least one of a first terminal part formed on one surface and first short side of the base substrate, and having one end connected to one end of the first radiation pattern; and a third terminal part formed on the other surface and the first short side of the base substrate, and having one end connected to one end of the second radiation pattern.

6. The ring type antenna module of claim 4, wherein the other terminal part comprises at least one of a second terminal part formed on one surface and second short side of the base substrate, and having one end connected to the other end of the first radiation pattern; and a fourth terminal part formed on the other surface and the second short side of the base substrate, and having one end connected to the other end of the second radiation pattern.

7. The ring type antenna module of claim 1, wherein the first guide part to the fourth guide part have a removal hole formed on the portion connected to the base substrate.

8. The ring type antenna module of claim 1, wherein the contact location between the terminal part and the other terminal part varies by varying the third guide hole and the fourth guide hole that are in contact with the first guide hole and the second guide hole.

9. A ring type antenna module, comprising a base substrate having flexibility on which a radiation pattern is formed;

a terminal part formed on one end of the base substrate and connected to one end of the radiation pattern;

the other terminal part formed on the other end of the base substrate and connected to the other end of the radiation pattern; and a magnetic sheet bonded to one surface of the base substrate, wherein the magnetic sheet is a plurality of divided magnetic sheets that are spaced apart from each other and bonded to one surface of the base substrate.

10. The ring type antenna module of claim 9, wherein the spacing distance between the divided magnetic sheet and the other divided magnetic sheet reduces toward the base substrate.

11. The ring type antenna module of claim 9, wherein the divided magnetic sheet has an inclined portion formed on at least one side surface of the side surfaces adjacent to the other divided magnetic sheet.

12. The ring type antenna module of claim 11, wherein the inclined portion has the spacing distance with the other divided magnetic sheet reducing toward the base substrate.

13. The ring type antenna module of claim 9, wherein the divided magnetic sheet comprises an adhesive layer having one surface adhered to the base substrate;

a magnetic layer formed with an area narrower than the adhesive layer, and having one surface stacked on the other surface of the adhesive layer; and a protection layer formed with an area narrower than the magnetic layer, and stacked on the other surface of the magnetic layer.

* * * * *